US006724414B2

(12) United States Patent
Masuda et al.

(10) Patent No.: US 6,724,414 B2
(45) Date of Patent: Apr. 20, 2004

(54) IMAGING DEVICE ARRAY, OPTICAL WRITING UNIT AND IMAGE FORMING APPARATUS

(75) Inventors: Koji Masuda, Yokohama (JP); Masahiro Itoh, Asaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/153,588

(22) Filed: May 24, 2002

(65) Prior Publication Data

US 2003/0007067 A1 Jan. 9, 2003

(30) Foreign Application Priority Data

May 24, 2001 (JP) ..... 2001-155422
May 24, 2001 (JP) ..... 2001-155481

(51) Int. Cl.[7] ..... B41J 27/00
(52) U.S. Cl. ..... 347/244; 347/258

(58) Field of Search ..... 347/241, 244, 347/256, 258, 240; 359/438, 678, 833, 836, 837, 625; 250/216

(56) References Cited

U.S. PATENT DOCUMENTS 5,035,486 A * 7/1991 Inokuchi ..... 359/625
5,363,240 A * 11/1994 Miyashita ..... 359/625
6,177,667 B1 * 1/2001 Fujita et al. ..... 250/216

* cited by examiner

*Primary Examiner*—Hai Pham
(74) *Attorney, Agent, or Firm*—Oblon, Spivak, McClelland, Maier & Neustadt, P.C.

(57) ABSTRACT

An imaging device array of the present invention effectively reduces the influence of ghost light and flare light. An optical writing unit using the imaging device array and an image forming apparatus using the optical writing unit are also disclosed.

28 Claims, 29 Drawing Sheets

IMAGING DEVICE ARRAY, OPTICAL WRITING UNIT AND IMAGE FORMING APPARATUS

BACKGROUND OF THE INVENTION

1. Field of the Invention

The present invention relates to an imaging device array, an optical writing unit including the imaging device array, and an image forming apparatus including the optical writing unit.

2. Description of the Background Art

In parallel with the size reduction of a digital copier, printer, digital facsimile apparatus or similar image forming apparatus, there is an increasing demand for the size reduction of an optical writing unit that writes an image on a photoconductive element. Small size, optical writing units include one using a solid-state writing system in which an imaging device array focuses light beams issuing from a light emitting device array on a photoconductive element in the form of beam spots. The light emitting device array is implemented as an LED (Light Emitting Diode) array or an organic EL (ElectroLuminescence) device array. The solid-state writing system makes an optical path between the light source and the photoconductive element extremely short to thereby make the optical writing unit and therefore an image forming apparatus compact. Basically, the imaging device array has a number of imaging devices arranged in an array in one-to-one correspondence to the light emitting elements of the light emitting device array. A rod lens array is one of conventional imaging device arrays.

The problem with the imaging device array of the type described is that needless light, i.e., ghost light and flare light are condensed on an image plane at positions other than expected positions. Ghost light is condensed at an unexpected position to a certain degree, forming a beam spot. Flare light is substantially homogeneously distributed on the image plane without being condensed. When an image forming apparatus using the conventional imaging device array forms an image, such ghost light and flare light degrade the quality of the image.

SUMMARY OF THE INVENTION

It is an object of the present invention to provide an imaging device array capable of effectively reducing the influence of ghost light and flare light.

It is another object of the present invention to provide an optical writing unit using the above imaging device array and an image forming apparatus including the optical writing unit.

In accordance with the present invention, an imaging device array includes a plurality of unit imaging devices each including a lens portion made up of a first lens surface to which a light beam for imaging is incident and a second lens surface from which the light beam is output, and a roof prism portion for reflecting the light beam incident via the first lens surface toward the second lens surface. The unit imaging devices are arranged integrally with each other such that the first lens surfaces, second lens surfaces and roof prism portions each are arranged in a respective array. Light attenuating members each intervene between nearby lens portions for attenuating light propagating between the lens portions. The light attenuating members have an attenuation ratio $\alpha$ smaller than 0.25 each.

An optical writing unit using the above imaging device array and an image forming apparatus including the optical writing unit are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1A:
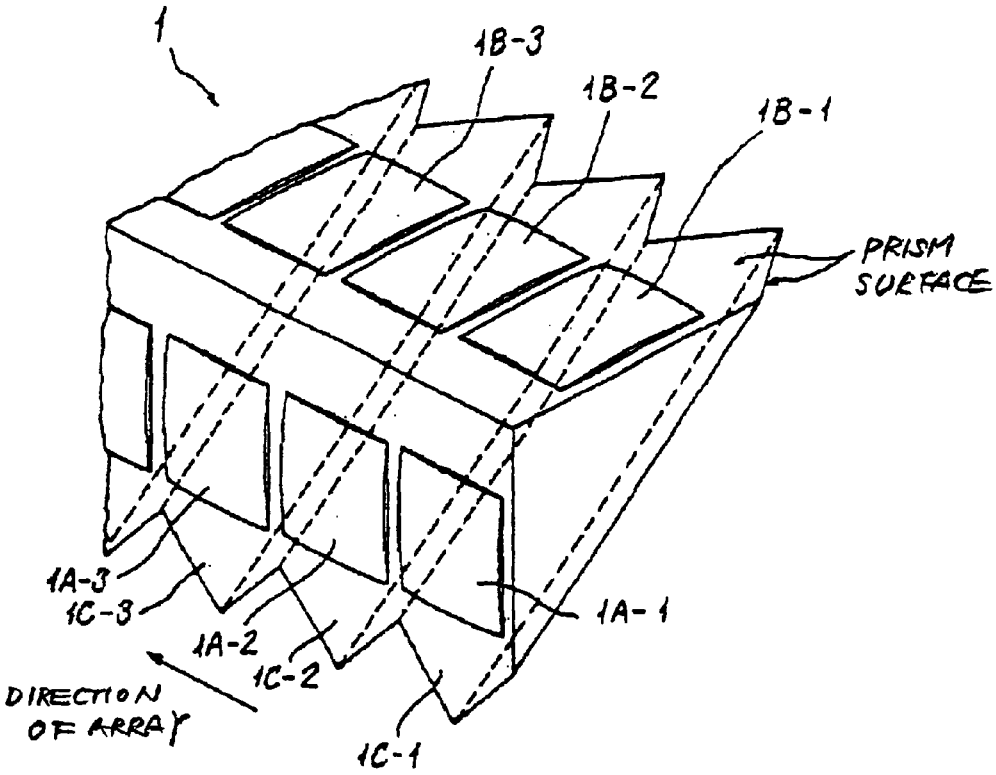
FIG. 1A PRIOR ART
FIGS. 1A and 1B are views showing a conventional imaging device array.

To better understand the present invention, conventional technologies and problems therewith will be described hereinafter. FIG. 1A shows a specific, conventional imaging device array 1 having a generally triangular cross-section. First lens surfaces 1A-1, 1A-2, 1A-3 and so forth on which light beams are to be incident are formed on one face of the trigonal prism. Second lens surfaces 1B-1, 1B-2, 1B-3 and so forth from which imaging light beams are to be output are formed on another face of the trigonal prism. The first lens surfaces and second lens surfaces correspond one-to-one to each other; one first lens surface and one second lens surface corresponding to each other constitute a lens portion. The first lens surfaces are arranged in the axial direction of the trigonal prism, and so are the second lens surfaces.

Roof prism portions 1C-1, 1C-2, 1C-3 and so forth are formed on the remaining face of the trigonal prism. Each roof prism portion has two flat prism surfaces that are combined perpendicularly to each other with a ridge therebetween extending perpendicularly to the axis of the trigonal prism. The roof prism portions are arranged side by side in the axial direction of the trigonal prism, as illustrated.

The first lens surface 1A-n (n=1, 2, 3 . . . ), second lens surface 1B-n and roof prism portion 1C-n constitute a unit imaging device. In the unit imaging device, a light beam is incident to the first lens surface 1A-n, reflected by the roof prism portion 1C-n, and focused by the combined lens operation of the first and second lens surfaces 1A-n and 1B-n.

Figure 1B:
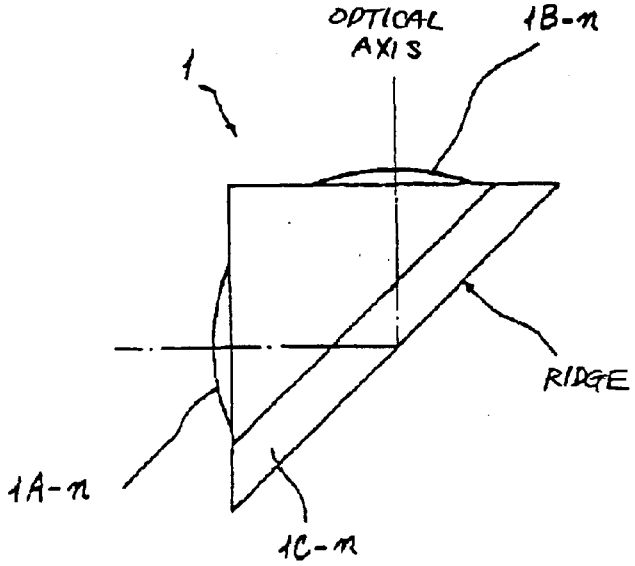
FIG. 1B PRIOR ART

As shown in FIG. 1B in a side elevation, the face where the first lens surfaces 1A-n are arranged and the face where the second lens surfaces 1B-n are arranged are perpendicular to each other. The ridge of each roof prism portion 1C-n is inclined by an angle of 45° relative to the above two faces. In FIG. 1B, the optical axes of all the first lens surfaces 1A-n are aligned with each other, and so are the axes of all of the second lens surfaces 1B-n. The axis of each first lens surface and that of the corresponding second lens surface meet each other on the ridge of the corresponding roof prism portion perpendicularly to each other.

Figure 2:
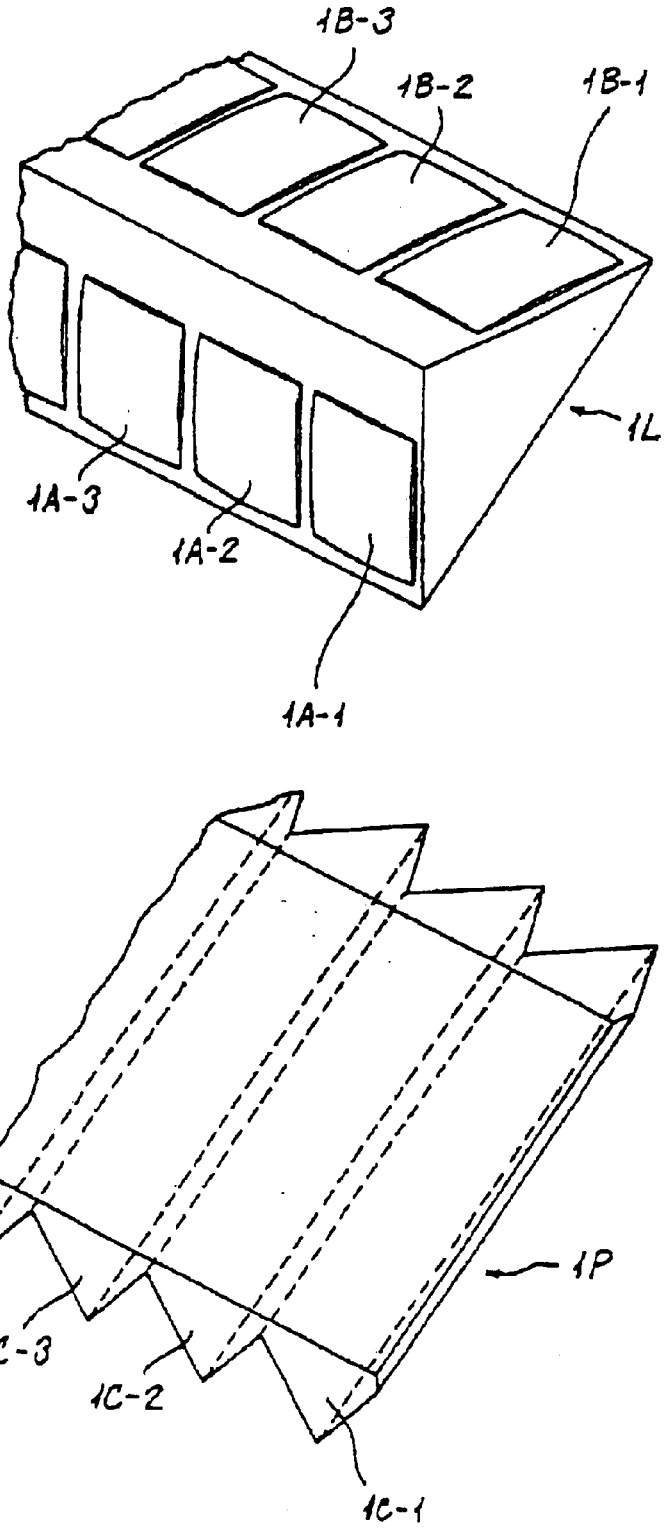
FIG. 2 PRIOR ART
FIG. 2 is a view showing a lens section and a roof prism section included in the conventional imaging device array in a virtually divided condition.

FIG. 2 shows the section 1L of the imaging device array 1 including the lens portions the section IP of the same including the roof prism portions in a virtually separated condition.

Figure 3A:
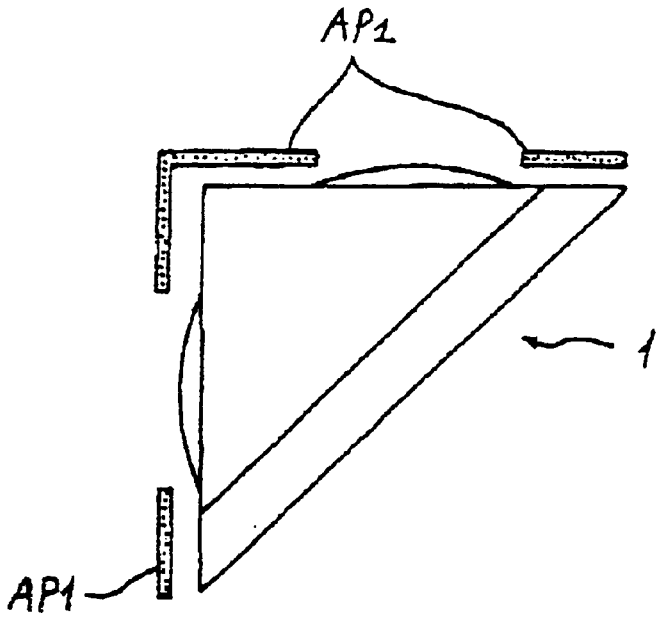
FIG. 3A PRIOR ART
FIGS. 3A and 3B are views each showing a particular configuration of an aperture applied to the conventional imaging device array.
Figure 3B:
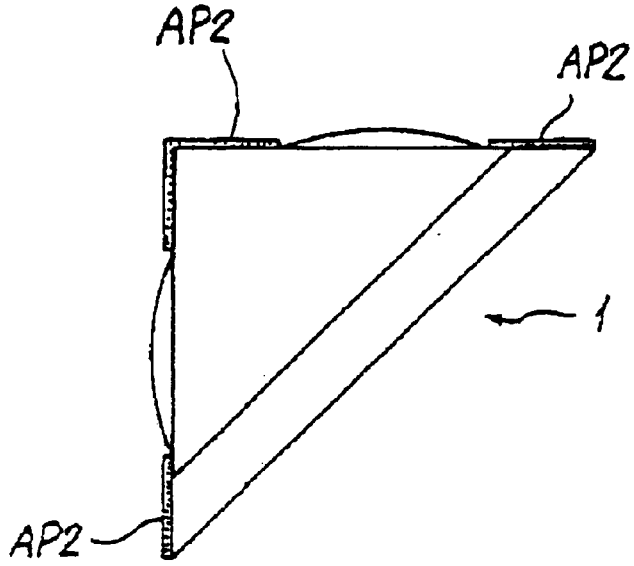
FIG. 3B PRIOR ART

In the configuration shown in FIGS. 1A and 1B, light incident to the area of the face where the first lens surfaces are arranged, but the first lens surfaces are absent, propagates through and then leaves the array 1 as needless light. However, such light sometimes reaches an image plane and disfigures an image formed by the imaging light. This problem can be effectively solved if an aperture is used to intercept light to be incident to and output from the areas other than the lens surfaces. FIG. 3A shows a specific aperture AP1 formed of black resin or implemented as a black metallic sheet and mounted to the array 1. FIG. 3B shows an aperture AP2 implemented by, e.g., black ink directly printed on or coated on the array 1.

Figure 4:
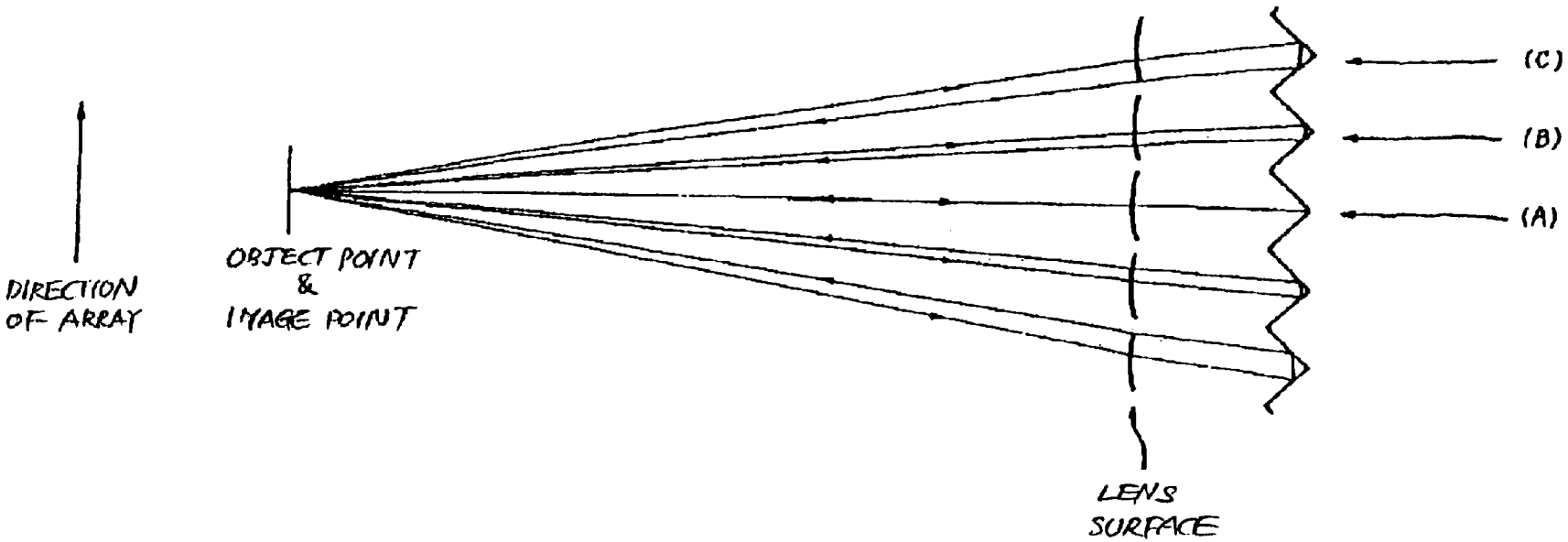
FIG. 4 PRIOR ART
FIG. 4 demonstrates how an imaging device array focuses incident light.

FIG. 4 shows optical paths along which focused light rays output from the imaging device array propagate. While the optical paths are tridimensional in practice, they are shown as being bidimensional in FIG. 4 in order to avoid complexity. In FIG. 4, imaging devices (A), (B) and (C) are representative of the individual unit imaging devices described above. Also, "lens surfaces" are representative of the first lens surfaces and second lens surfaces of the individual unit imaging devices virtually superposed on each other. Therefore, in FIG. 4, the object point and image point of each focusing device are coincident with each other. More specifically, in practice, a light beam incident to each lens surface is reflected by the corresponding roof prism portion and then output via the second lens surface to be focused thereby. FIG. 4 translates such a condition to a condition wherein a light beam incident to the lens surface from an object point is reflected by the roof prism portion, output via the imaging device array via the same lens surface, and then focused on an image point coincident with the object point.

As shown in FIG. 4, light issuing from the object point is incident to the lens surface (first lens surface) of the imaging device (A), totally reflected by the room prism portion (two prism surfaces) of the device (A) and then output from the lens surface (second lens surface) to reach the image point coincident with the object point in the direction of the array. At this instant, the light always propagates through the imaging device (A). This is also true with light incident to the other imaging devices (B) and (C) and even with imaging devices opposite in position to the imaging devices (B) and (C) with respect to the imaging device (A).

The condition shown in FIG. 4 wherein light reaches an image point coincident with an object point in the direction of the array is generally referred to as an erecting x1 system. In FIG. 4, light issuing from a given object point forms a single image point by way of a plurality of imaging devices. Such light being focused on the object point by the erecting x1 system is referred to as main light. FIG. 4 therefore shows how main light is focused.

Figure 5:
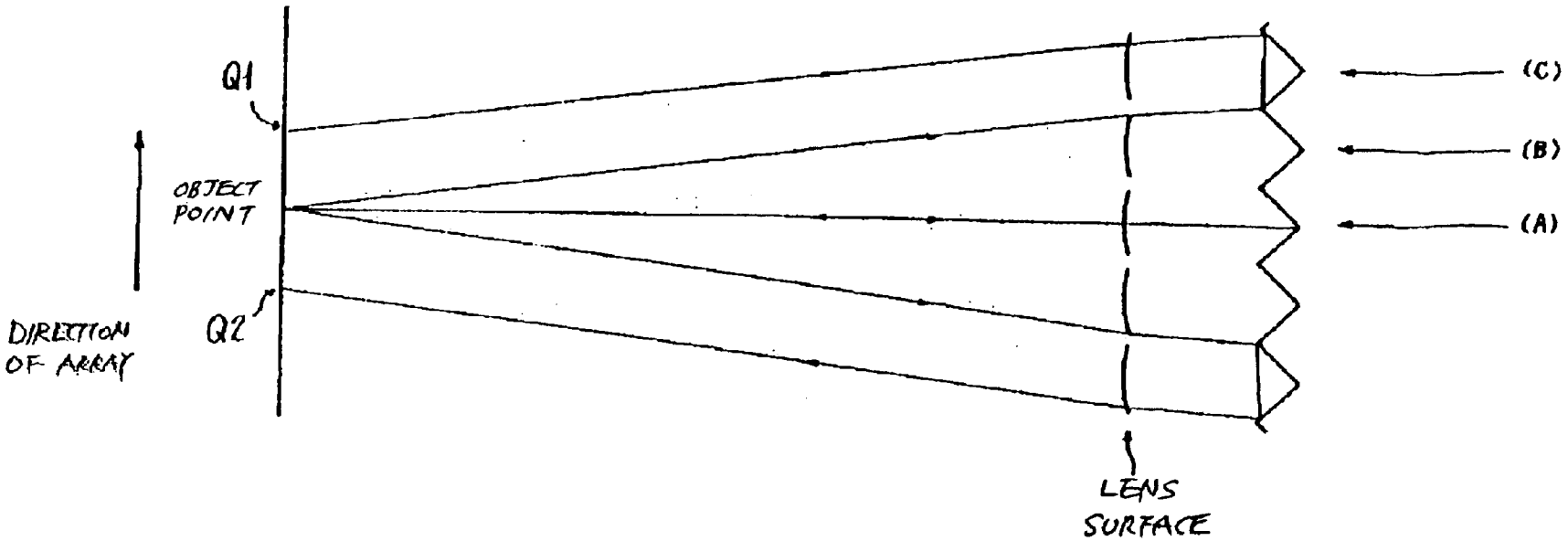
FIG. 5 PRIOR ART
FIGS. 5 and 6 show needless light output from an imaging device array.
Figure 6:
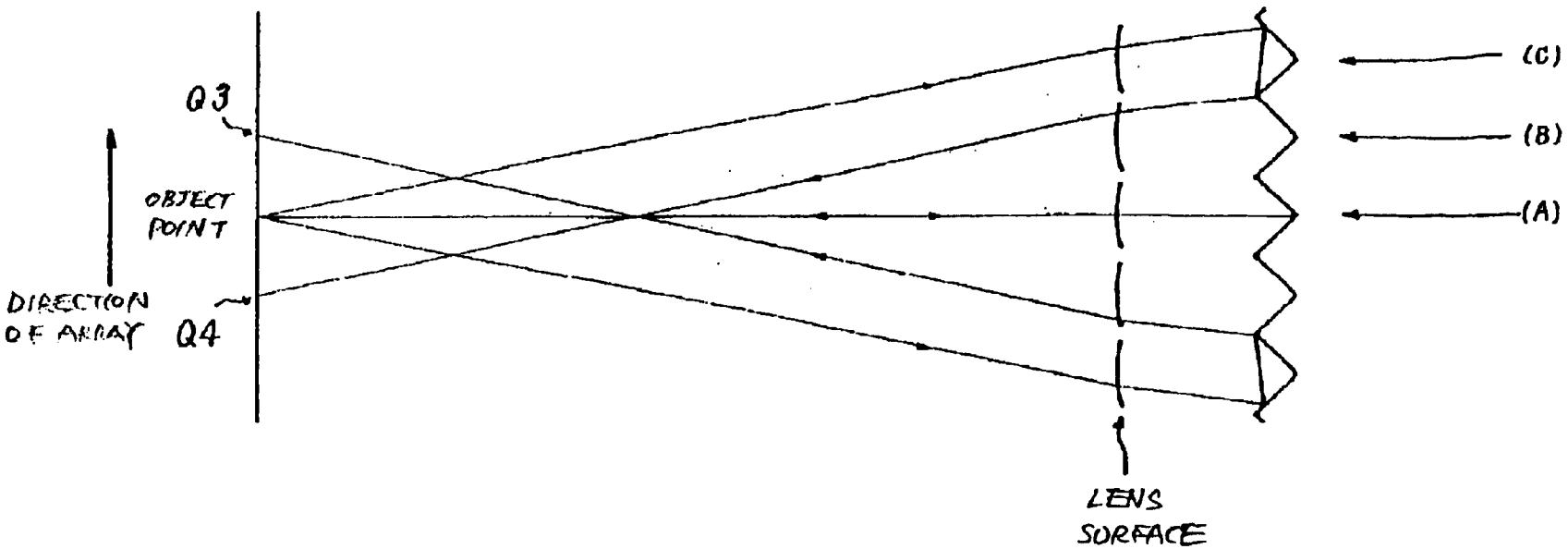
FIG. 6 PRIOR ART

FIGS. 5 and 6 are views similar to FIG. 4, but each showing a particular condition wherein part of light issuing from an object point reaches an image plane in place of an object point as needless light. As shown in FIG. 5, light issuing from an object point and incident to the lens surface of the imaging device (A) is totally reflected by the roof prism portion, and then output via the corresponding lens surface to reach an image point (main light). However, light incident to the lens surface (first lens surface) of the imaging device (B) propagates between the imaging devices (B) and (C) and is totally reflected by the roof prism portion of the imaging device (C) and then output via the lens surface (second lens surface) of the imaging device (C) to reach a point Q1 different from the object point as needless light. Needless light also reaches a point Q2 symmetrical to the point Q1 with respect to the image point; that is, light propagating between nearby lens portions on the first lens side is needless.

In FIG. 6, light issuing from the object point and incident to the lens surface of the imaging device (A) is totally reflected by the roof prism portion and then output via the corresponding lens surface to reach the object point (A). However, light incident to the lens surface (first lens surface) of the imaging device (C) is totally reflected by the corresponding roof prism portion, propagated between the imaging devices (C) and (B), and then output via the lens surface (second lens surface) of the imaging device (B) to reach a point Q4 different from the object point as needless light. Needless light is also incident to a point Q3 symmetrical to the point Q4 with respect to the image point; that is, light propagating between nearby lens portions on the second lens side is needless.

If the points Q1 and Q2, FIG. 5, or the points Q3 and Q5, FIG. 6, are relatively close to each other, then needless light is condensed at such position although it is not focused like main light, but concentrates in a certain range. When needless light is so condensed to form a beam spot, the needless light is referred to as ghost light. On the other hand, needless light substantially homogeneously distributed on an image plane without being condensed is referred to as flare light.

Generally, in the imaging device array shown in FIGS. 1A and 1B, ghost light is apt to appear at a position remote from the object point of main light in the direction of the array. The position at which ghost light is condensed is dependent on the pitch P of the imaging devices and the shape of the unit imaging device.

Japanese Patent Publication No. 5-053245 discloses a method of reducing needless light by forming a slit in the first lens surface. However, the slit is not sufficiently effective because needless light propagates not only at the first lens side between nearby lens portions (FIG. 5), but also at the second lens side (FIG. 6). Moreover, the slit undesirably forms another optical path for needless light.

Figure 7:
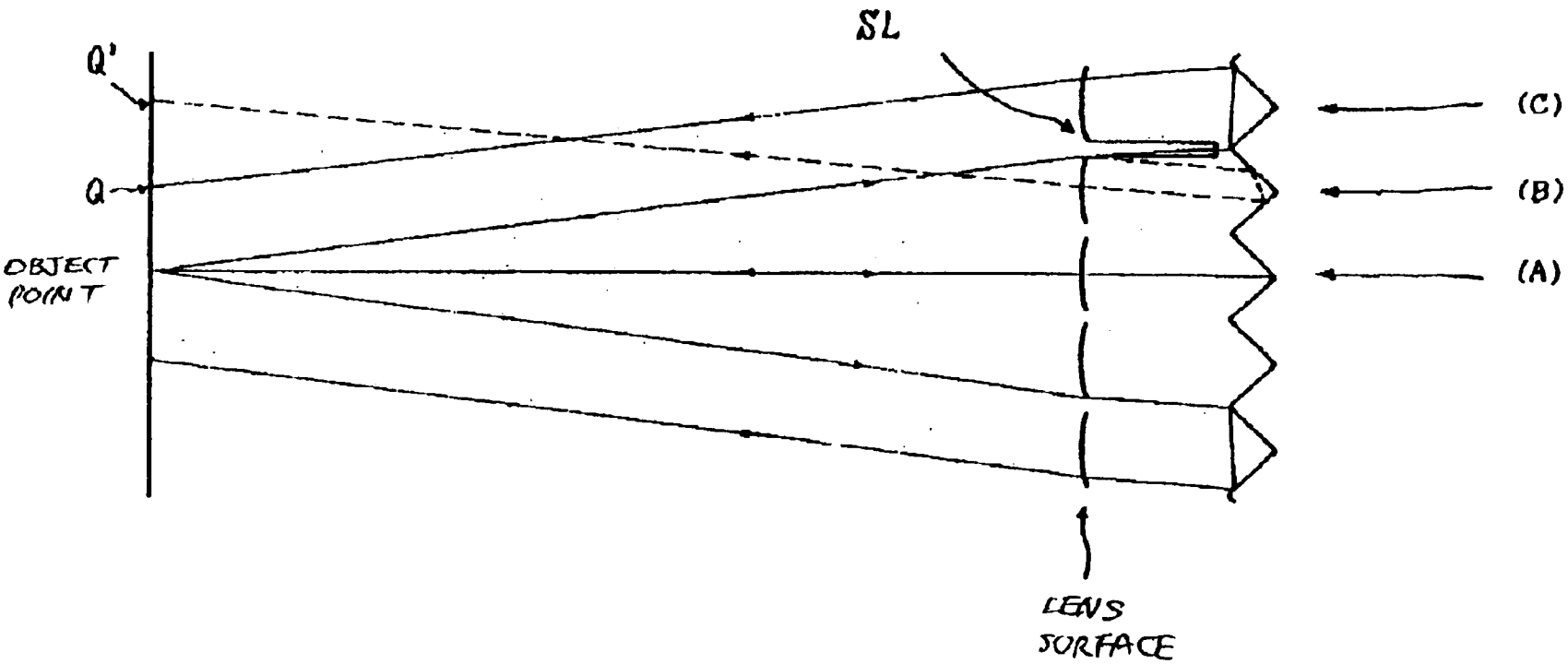
FIG. 7 PRIOR ART
FIG. 7 shows needless light ascribable to a slit formed in an imaging device array.

More specifically, as shown in FIG. 7 similar to FIG. 4, a slit SL is formed between nearby lenses of the imaging devices (B) and (C) at the first lens side. Generally, the imaging device array is formed of resin and has a refractive index of about 1.5; the slit has a refractive index of 1 in the air portion. Light issuing from tea object point, incident to the first lens surface and then incident to the wall of the slit SL has a substantial refractive index. Such incident light has an incidence angle greater than a critical angle determined by a material with a refractive index of about 1.5 and a material with a refractive index of 1 (air) and is therefore totally reflected by the wall of the slit SL.

As indicated by a dashed line in FIG. 7, the light totally reflected by the wall of the slit SL is totally reflected by the roof prism portion of the imaging device (B) and then output via the lens surface of the imaging device (B) to reach a position Q'. This position Q is different from the point Q, FIG. 5, at which the optical path represented by a solid line (no slit) terminates. Stated another way, the slit SL simply replaces the point Q with the point Q'. Further, because the slit SL totally reflects the needless light (reflectance of 100%), the energy of the needless light is the same at both of the points Q and Q'.

Figure 8A:
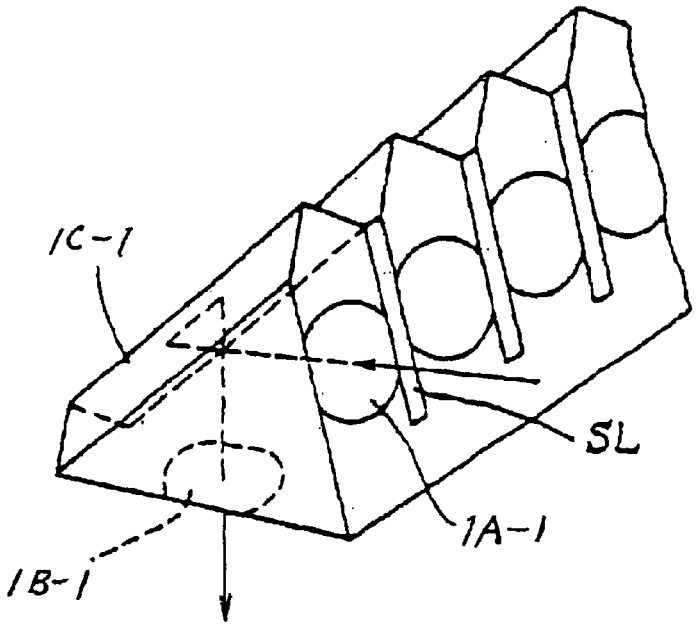
FIG. 8A PRIOR ART
FIGS. 8A and 8B are views showing another conventional imaging device array with an aperture.
Figure 8B:
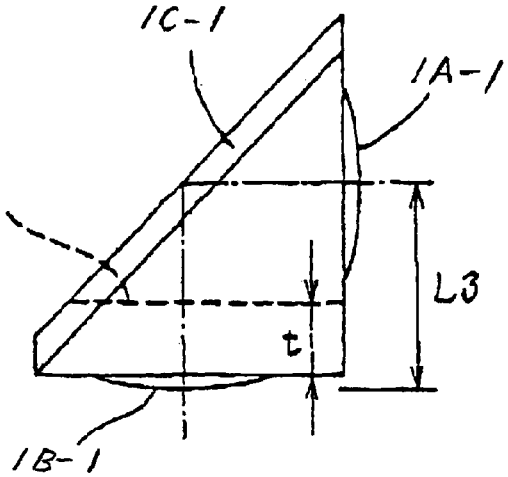
FIG. 8B PRIOR ART

FIG. 8A shows the imaging device array in which nearby first lens surfaces at the incidence side are isolated from each other by the slit SL, so that ghost light does not appear. However, as shown in FIG. 8B, a region having a width t where the slit SL is not formed exists between the second lens surfaces at the output side; the width t corresponds to the thickness of the array at the slit portion. Therefore, it is impossible to fully obviate ghost light. Moreover, the walls of the slits SL are not processed at all.

Figure 9:
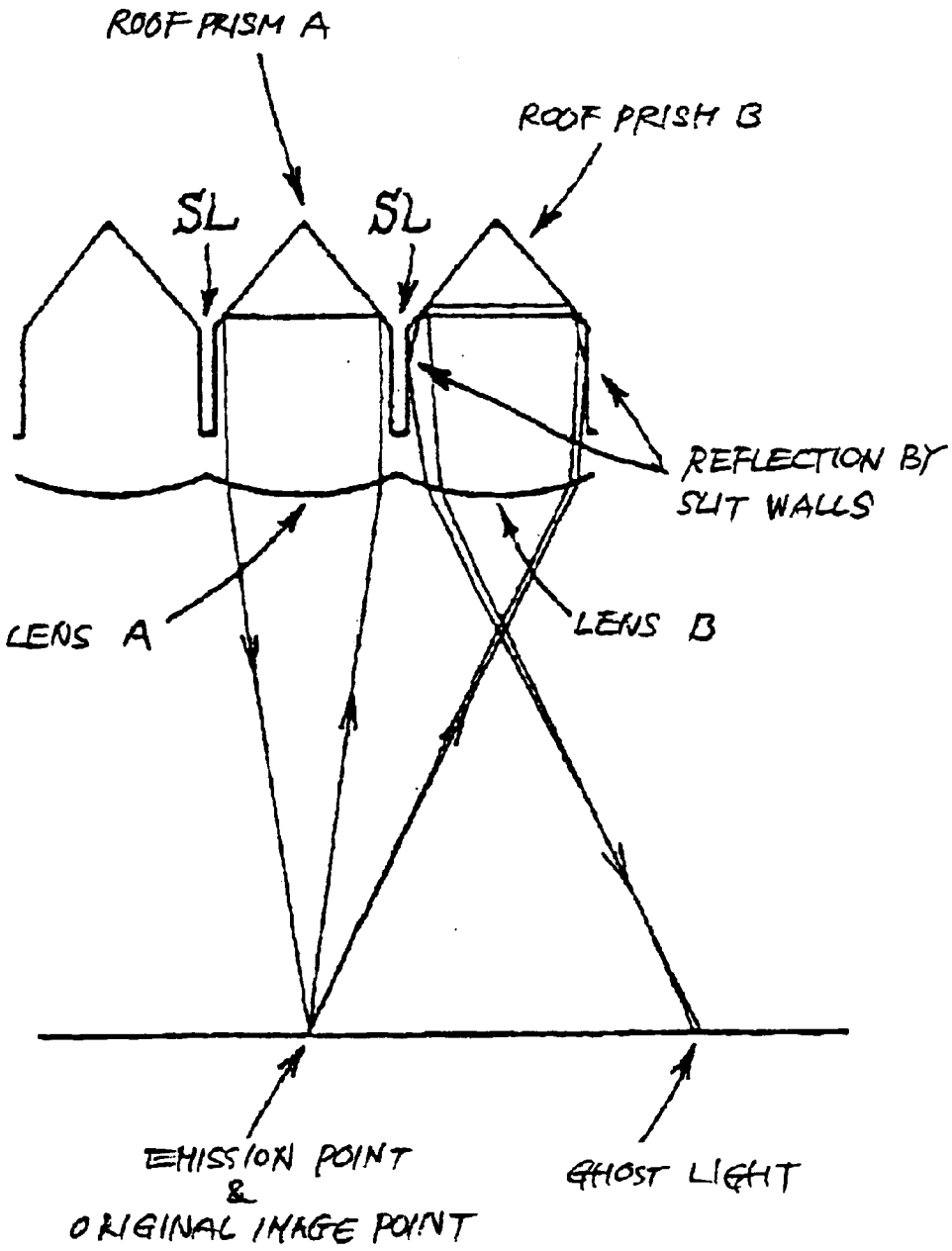
FIG. 9 PRIOR ART
FIG. 9 shows ghost light ascribable to reflection occurring at the side walls of the slit.

As shown in FIG. 9, so long as a lens A (incidence side) is positioned at the front of a light source (emission position), i.e., the light source adjoins the optical axis of the lens A, light incident to the lens A is successfully reflected by a roof prism A associated with the lens A and then output via the lens A. However, the optical paths of light issuing from the above light source and incident to a lens B (incidence side) next to the lens A include paths that are not directly incident to a roof prism B or, if directly incident, terminate at the walls of the slit SL. If the walls of the slit SL are not processed at all, then such light incident to the walls of the slit SL is reflected thereby, propagated through the lens B, and then condensed at a position different from the expected imaging position as ghost light.

The influence of ghost light on an image to be formed by an optical writing type of image forming system will be described hereinafter. We experimentally found that when an optical writing unit mad up of the imaging device array of FIG. 1 and a light emitting device array exposed a photoconductive element, images presumably ascribable to ghost light appeared in the resulting toner image. A ghost ratio to appear in the following description refers to a ratio of the integrated quantity of ghost light to the integrated quantity of main light.

Figure 10A:
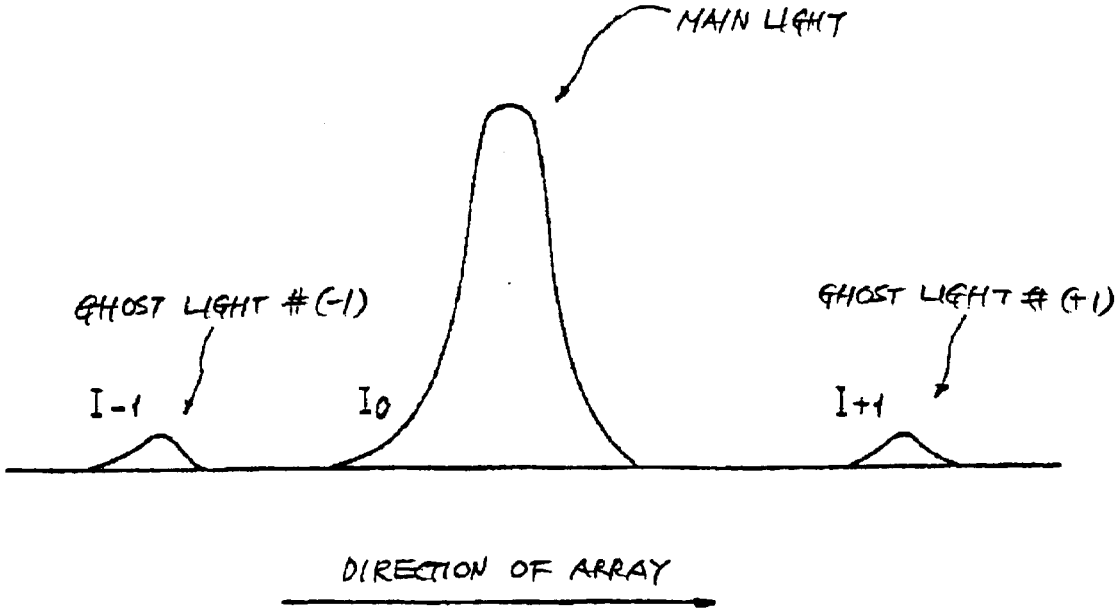
FIG. 10A PRIOR ART
FIGS. 10A and 10B show ghost light and the influence thereof on an image.

FIG. 10A shows specific profiles of light quantity distributions formed on an image plane by the imaging device array 1. As shown, the profiles of ghost light (light quantity distributions of condensed ghost light) appear at positions remote from the profile of main light (light quantity distribution of main light) in the direction of the array.

A plurality of positions where ghost light may appear will be distinguished by #m (=±1, ±2, . . . ) hereinafter while ghost light condensed at the position #m will be referred to as ghost light #m. Assume that the integrated quantity of main light (total quantity of main light) is Io, and that the integrated quantity of ghost light #m (total quantity of ghost light) is Im. Then, the ghost ratio Gm of the ghost light #m is expressed as:

$$Gm=Im/Io(m=\pm1, \pm2, \ldots)$$

That is, the ghost ratio Gm is a dimensionless quantity.

For example, a current fed to a light emitting device is increased, the quantity of light issuing from the light emitting device increases. However, a greater quantity of light translates into a greater integrated quantity of main light Io and therefore a greater integrated quantity of ghost light Im. In this manner, although the integrated quantity of ghost light Im itself is dependent on the quantity of light to issue from a light emitting device, the ghost ratio Gm is not dependent on it. Further, the amount of energy for exposing a photoconductive element (exposure energy) is the product of the integrated quantity of main light and exposing time. It follows that if a ghost ratio is known beforehand and if exposure energy is given, then the exposure energy of ghost light can also be unconditionally calculated by using the ghost ratio. A ghost ratio is therefore easier to deal with than the integrated quantity of ghost light itself.

A ghost ratio depends on the configuration of the imaging device array. To allow an image forming apparatus to output an image at high speed, optics should preferably be light enough to increase the integrated quantity of main light. Also, to enhance image quality, main light should preferably form a small beam spot on a photoconductive element. Two specific configurations of an imaging device array studied from such a standpoint will be described hereinafter.

Parameters relating to the configuration of the imaging device array and used for the study are as follows;

P: pitch of unit imaging devices arranged in an array

Apx: aperture of first and second lens surfaces in the direction of the array

Apy: aperture of first and second lens surfaces in the direction perpendicular to the array L0: distance between an object plane to first lens surface L1: distance between first lens surface and ridge of roof prism portion L2: distance between ridge of roof prism portion and second lens surface L3: distance between second lens surface and image plane R1: radius of curvature of first lens surface R2: radius of curvature of second lens surface N: refractive index of material of array at waveform used While each lens surface is spherical, it may alternatively be coaxial aspherical, troidal (including aspherical) or freely curved, if desired.

A first configuration studied had the following parameters:

P=0.8 mm

Apx=0.6 mm

Apy=0.8 mm

L0=L3=10 mm

L1=L2=1.5 mm

R1=4.967 mm

R2=−4.967 mm

N=1.49

Figure 11A:
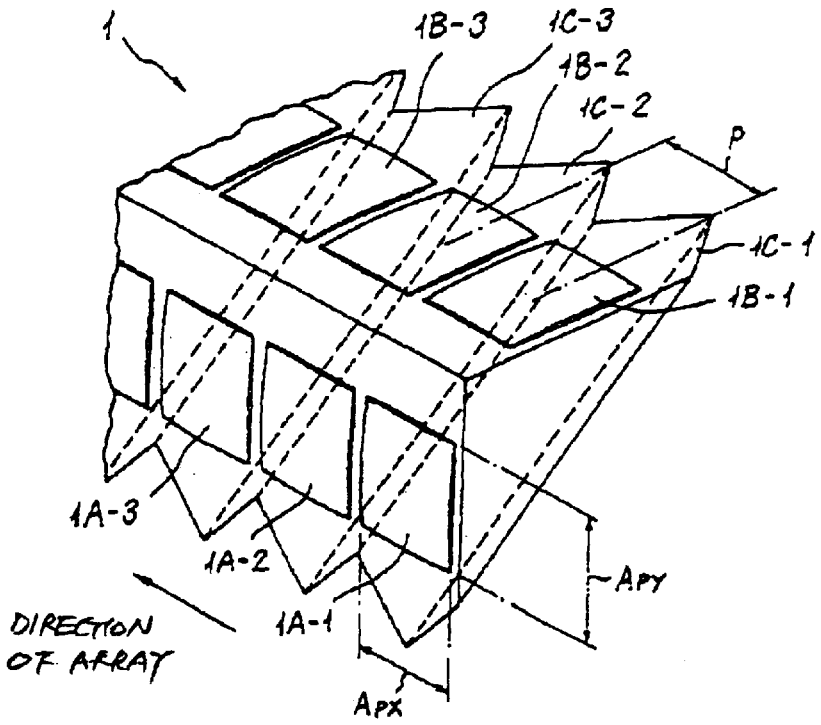
FIG. 11A PRIOR ART
FIGS. 11A and 11B show parameters included in an imaging device array.
Figure 11B:
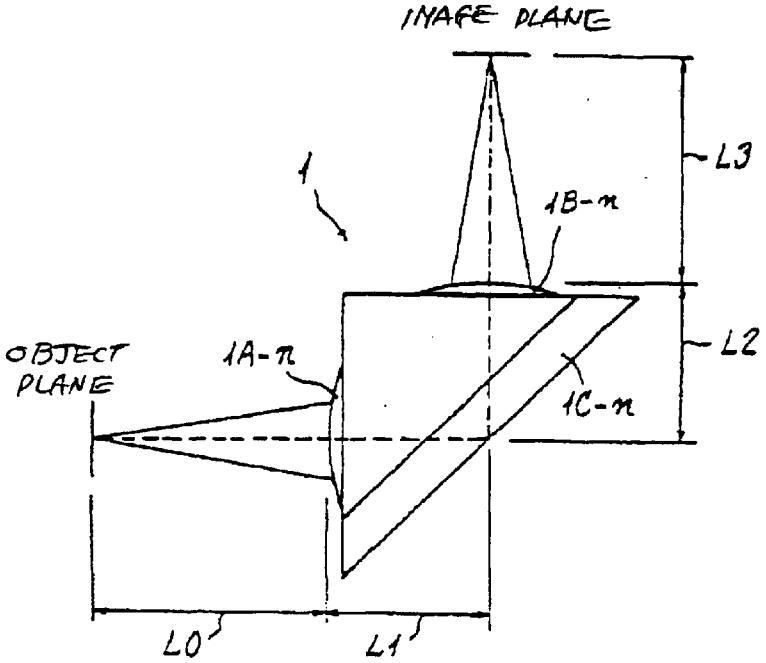
FIG. 11B PRIOR ART

An LED having a 20 μm square, light emitting portion was assumed to be an object point and to constitute a perfect diffuse light source with a Lambert emission pattern. Under this condition, a ghost ratio of the imaging device array was determined by optical simulation. As shown in FIG. 11B, the object point was set on the optical axis of the first lens surface. The simulation showed that ghost light #±1 appeared at a position remote from the image position of main light by ±0.9 mm in the direction of the array and had a ghost ratio of $G_{+1} \approx G_{-1} = 26\%$.

A second configuration studied had the following parameters:

P=0.8 mm

Apx=0.6 mm

Apy=0.8 mm

L0=L3=6 mm

L1=L2=1.4 mm

R1=2.983 mm

R2=−2.983 mm

N=1.49

Again, an LED having a 20 μm square, light emitting portion was assumed to be an object point and to constitute a perfect diffuse light source with a Lambert emission pattern. Under this condition, a ghost ratio of the imaging device array was determined by optical simulation. As shown in FIG. 11B, the object point was set on the optical axis of the first lens surface. The simulation showed that ghost light #±1 appeared at a position remote from the image position of main light by ±0.9 mm in the direction of the array and had a ghost ratio of $G_{+1} \approx G_{-1} = 19\%$.

Figure 10B:
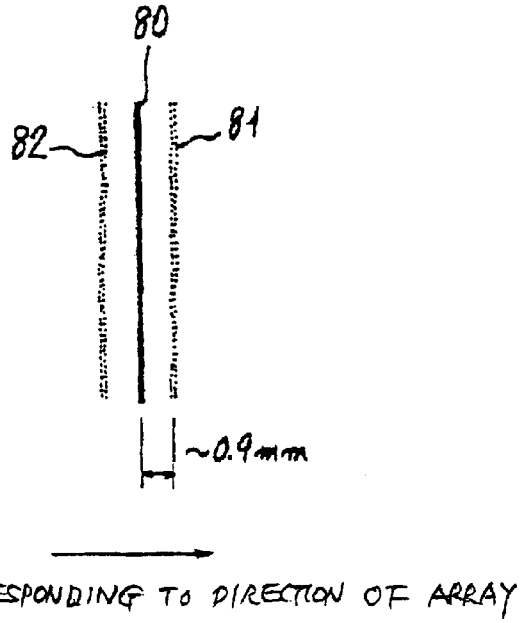
FIG. 10B PRIOR ART

As the two specific configurations indicate, the conventional imaging device array has a ghost ratio substantially ranging from 20% to 25%. The two configurations each were combined with a 600 dpi (dots per inch) LED array to constitute an optical writing unit and formed a vertical line pattern perpendicular to the direction of the array on a photoconductive element. FIG. 10B shows the resulting image. As shown, the image included a vertical line 80 formed by main light and two thin, vertical lines 81 and 82 positioned at both sides of the vertical line 80 and presumably ascribable to ghost light. The distance between the line 80 and each adjoining line 81 or 82 was about 0.9 mm and corresponded to a distance between ghost light.

As stated above, the conventional imaging device array causes ghost light to appear and lower image quality when combined with a light emitting device array.

First Embodiment

We experimentally examined the influence of the ghost ratio on various kinds of images and found that the level of the ghost ratio having no influence on images was between substantially between 5% and 6%. Ghost ratios lying in such a range do not produce any visible pattern ascribable to ghost light. It is to be noted that the above ghost ratio level should not be considered to be a single definite value because the ghost ratio level not influencing images is dependent on the construction of an image forming apparatus and process conditions for image formation.

The object of the present invention is to reduce the ghost ratio to a level that does not influence images. Although the ghost ratio should ideally be zero, zero ghost ratio is, in practice, difficult to achieve for technical reasons. Further, excessively reducing the ghost ratio is not desirable from the cost standpoint. As for practical use, it suffices to reduce the ghost ratio of 20% to 25% particular to the conventional imaging device array to 5% to 6%.

Ghost light is derived from light propagating between nearby lenses, as stated earlier, so that attenuating such light is effective to reduce the ghost ratio. In addition, the attenuation of the above light has no undesirable influence on the integrated quantity of main light.

The ghost ratio level of 5% to 6% not influencing images is about one-fourth (25%) of the ghost ratio of 20% to 25% of the conventional imaging device array. It follows that if the light propagating between nearby lenses is attenuated to 0.25 of the conventional imaging device array or below, then an imaging device array not influencing images can be realized. More specifically, assuming that a light attenuation ratio is α, then the above relation is expressed as:

$$\alpha < 0.25 \quad (1)$$

Figure 12A:
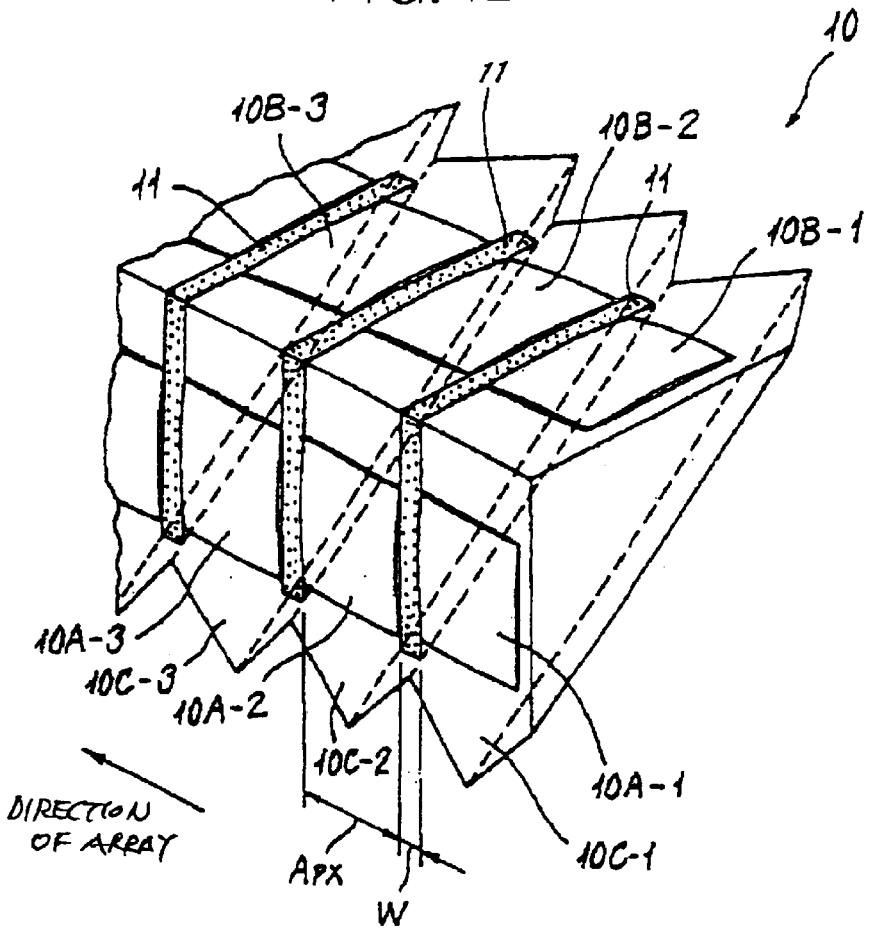
FIGS. 12A and 12B are views showing a first embodiment of the imaging device array in accordance with the present invention.
Figure 12B:
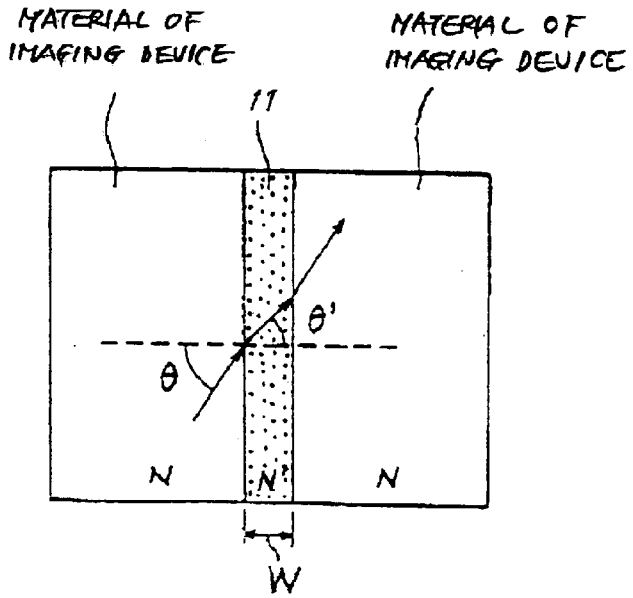

Referring to FIGS. 12A and 12B, an imaging device array embodying the present invention will be described. As shown in FIG. 12A, the imaging device array, generally 10, has a trigonal prism configuration. First lens surfaces 10A-1, 10A-2, 10A-3 and so forth on which light beams are to be incident are formed on one face of the trigonal prism. Second lens surfaces 10B-1, 10B-2, 10B-3 and so fort from which imaging light beams are to be output are formed on another face of the trigonal prism. The first lens surfaces and second lens surfaces correspond one-to-one to each other; one first lens surface and one second lens surface corresponding to each other constitute a lens portion. The first lens surfaces are arranged in the axial direction of the trigonal prism, and so are the second lens surfaces.

Roof prism portions 10C-1, 10C-2, 10C-3 and so forth are formed on the remaining face of the trigonal prism. Each roof prism portion has two flat prism surfaces that are combined perpendicularly to each other with a ridge therebetween extending perpendicularly to the axis of the trigonal prism. The roof prism portions are arranged side by side in the axial direction of the trigonal prism, as illustrated.

The first lens surface 10A-n (n=1, 2, 3 . . . ), second lens surface 10B-n and roof prism portion 10C-n constitute a unit imaging device. In the unit imaging device, a light beam is incident to the first lens surface 10A-n, reflected by the room prism portion 10C-n, and then output from the second lens surface 10B-n. The light beam is focused by the combined lens operation of the first and second lens surfaces 10A-n and 10B-n. In this manner, the imaging device array 10 has a plurality of unit imaging devices integrally arranged such that the first and second lens surfaces and roof prism portions each are positioned side by side in the same direction, i.e., the axial direction.

A light attenuating member 11 is positioned on the imaging device array 10 between nearby lens portions and has a width W in the direction of the array. In the illustrative embodiment, the pitch P of the unit imaging devices is the sum of the lens aperture and width W in the direction of the array, i.e., Apx+W.

Assume that the material of the imaging device array 10 has a refractive index N and an optical density k, and that the light attenuating member 11 has a refractive index N' and an optical density k'. Then, these factors satisfy the following relations:

$$N' \geqq N \tag{2}$$

$$(k'-k)>0.43/W \tag{3}$$

FIG. 10B shows the light attenuating member 11 having the width W positioned between the material constituting the imaging device array 10, i.e., between nearby lens portions. The light attenuating member 11 reduces the optical intensity of light propagating between nearby lens portions, as indicated by an arrow in FIG. 10B. The light attenuating member 11 is expected to attenuate the light that is propagating therethrough. The attenuating member 11 must therefore reduce the reflection of the above light toward the incidence side as far as possible and must take in the light by refraction while attenuating it inside the attenuating member 11. That is, the prerequisites with the light attenuating member 11 are (i) that it refracts light from the material of the imaging device array 10 toward the member 11, and (ii) that the member 11 attenuates light within the length of an optical path along which the light propagates through the member 11.

To meet the above prerequisite (i), i.e., to refract the light from the material with the refractive index N to the material with the refractive index N' without fail, there must be satisfied a relation of N'>N.

As for the prerequisite (ii), assume that light propagates through a material having an optical density k ($mm^{-1}$) over an optical path length T (mm). Then, energy Ein input to the above material and energy Eout output from the same satisfy the following relation:

$$Eout/Ein=10^{-kT} \tag{4}$$

It follows that energy E after the light propagated through the above material over the distance T and energy E' after the same light propagated through the light attenuating member 11 over a distance T' are related to incident energy E0, as follows:

$$E/E0=10^{-kT} \tag{5}$$

$$E'/E0=10^{-k'T'} \tag{6}$$

The light attenuating member 11 implements an attenuation ratio α expressed as:

$$\alpha=E'/E \tag{7}$$

Therefore, by using the above relation, the attenuation ratio α is defined as:

$$\alpha=10^{-K'T'}/10^{-kT} \tag{8}$$

As shown in FIG. 12B, assuming that the incidence angle of light from the material of the imaging device array to the light attenuating member 11 is θ, then a refraction angle θ' is produced by:

$$\sin\theta'=N\sin\theta/N' \tag{9}$$

Therefore, the optical path length T' in the light attenuating member 11 having the width W is expressed as:

$$T'=W/\cos\theta'(10)$$

On the other hand, if the light attenuating member 11 is absent, then the optical path length T is expressed as:

$$T=W/\cos\theta \tag{11}$$

However, if the difference between N and N' is small, then there holds θ'≈θ and therefore T'≈T. The attenuation ratio α is therefore produced by:

$$\alpha=10^{-T'(k'-k)} \tag{12}$$

Because the attenuation ratio must be smaller than 0.25, as stated above, there should only hold:

$$0.25>^{10-T(k'-k)} \tag{13}$$

The common logarithm of both sides of the above relation (13) is:

$$\log 0.25>-T'(k'-k) \tag{14}$$

Consequently, there should hold:

$$(k'-k)>-(\log 0.25)/T' \tag{15}$$

Further, the light propagating between nearby lens portions to become ghost light has a great angle θ and has a refraction angle θ'>45°, so that the following relation holds:

$$T'>\sqrt{2}\cdot W \tag{16}$$

Therefore, the light propagating between nearby lenses to become ghost light can be effectively reduced if there is satisfied the following condition in addition to the condition (ii):

$$(k'-k)>-\{(\log 0.25)/\sqrt{2}\}/W\approx 0.43/W \tag{17}$$

Ray tracing based on Snell's law teaches that if N'≧N holds, then refraction occurs at the boundary. However, regarding light as energy, at a boundary with a different refractive index, transmission and reflectance are determined by the refractive index (Fresnel equation). Therefore, light incident from the lens portion to the light attenuating member 11 is also reflected by the boundary between the lens portion and the member 11 and should preferably be reduced as far as possible.

In the Fresnel equation, transmission and reflectance are determined by the deflection components of light, i.e., P deflection and S deflection. When light is randomly deflected, its transmission TR and reflectance RF are respectively the mean value of the transmissions Tp and Ts of P deflection and S deflection and a mean value of the reflectances Rp and Rs of the same, i.e.:

$$TR=(Tp+Ts)/2 \tag{18}$$

$$RF=(Rp+Rs)/2 \tag{19}$$

Figure 13:
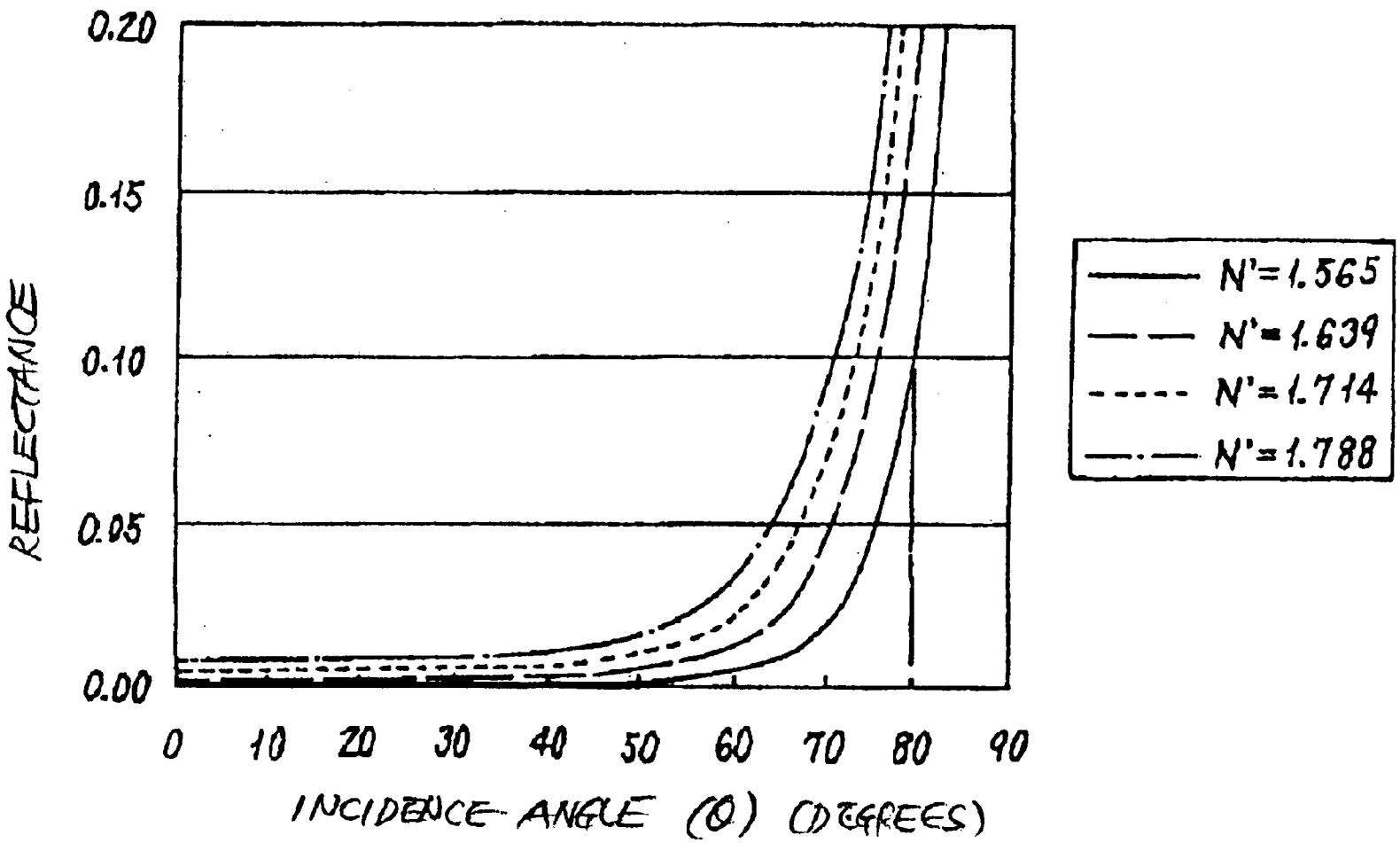
FIG. 13 is a graph showing a relation between the incidence angle and the reflectance of the illustrative embodiment.

When an LED array is used as a light source, light issuing from LEDs can be regarded as substantially randomly deflected light. Assume that light issuing from an emitting portion is randomly deflected light and that the material of the imaging device array 10 has a refractive index N of 1.49. Then, the reflectance RF varies with the incidence angle in accordance with the refractive index N' of the material of the light attenuating member 11, as shown in FIG. 13. As FIG. 13 indicates, to reduce the reflection component for a given incidence angle, the difference between N' and N should preferably be reduced.

While the light propagating between nearby lens portions has a substantial incidence angle θ, as stated earlier, $N' \leqq 1.05N$ can reduced the reflectance RF below 10% even if θ is around 70 to 80. More specifically, assuming that $\Delta N=(N'-N)/N$, then N should preferably lie in the range of:

$$0 \leqq \Delta N \leqq 0.05 \quad (20)$$

By satisfying the above condition, it is possible to effectively reduce the reflection component ascribable to the light attenuating member 11.

Figure 14:
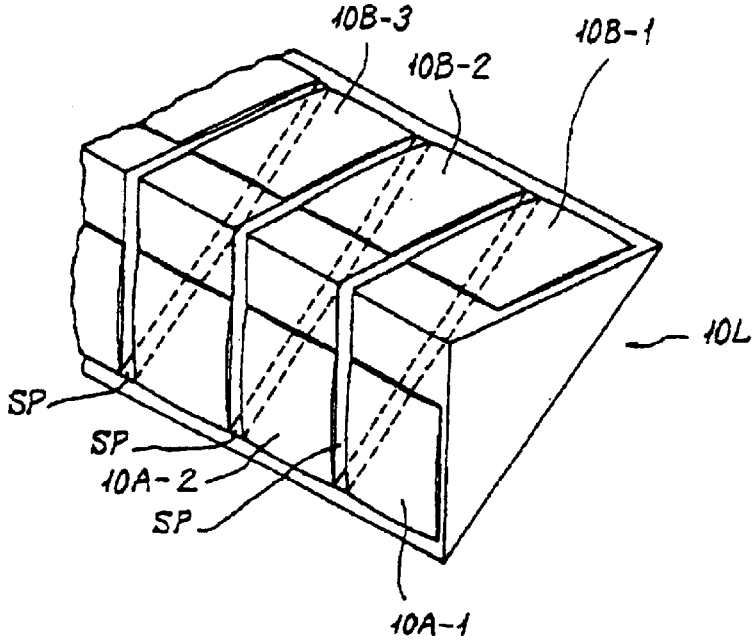
FIGS. 14 and 15 are views each showing a specific configuration of a slit included in the illustrative embodiment.
Figure 15:
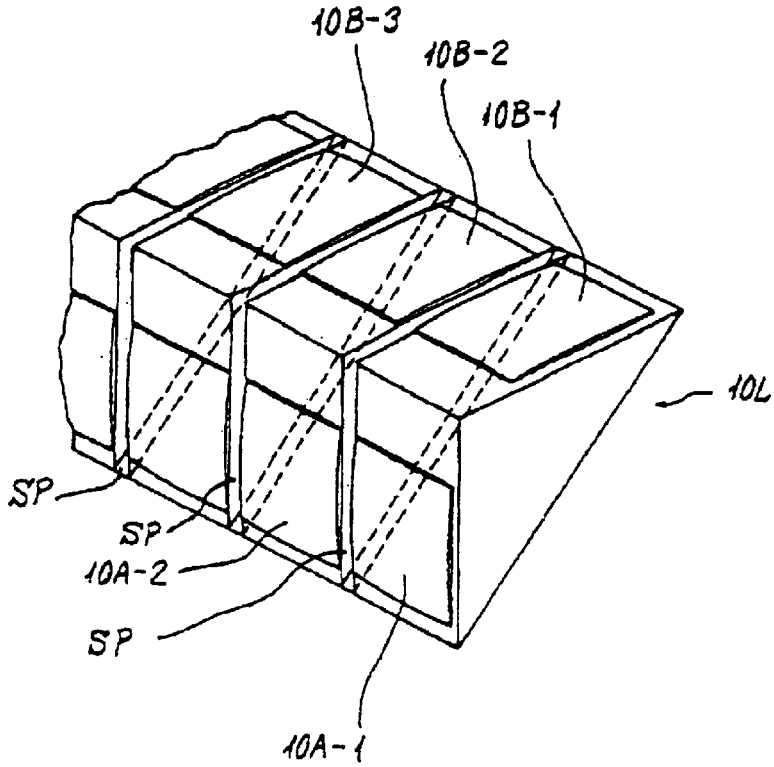

The light attenuating members 11 may be implemented by spaces formed between nearby lens portions, as will be described hereinafter. FIGS. 14 and 15 are views similar to FIG. 2, showing only the portion 10L of the imaging device array where the lens portions are arranged. In FIG. 14, spaces SP each are formed in the vicinity of the effective aperture of the first and second lens surfaces. In FIG. 15, spaces SP each are formed up to the edges of the lens portion. In any case, a light attenuating member should only be filled in each space SP. At this instant, the light attenuating member is caused to closely contact the boundaries between the lens portion and the space SP to thereby form a boundary between the material of the imaging device array (refractive index N) and that of the light attenuating member (refractive index N').

The space SP does not have to be formed between nearby roof prism portions because ghost light is derived from light propagating between nearby lens portions, as stated previously. To form the spaces SP, the imaging device array implemented as a single molding may be diced or otherwise mechanically processed, in which case the light attenuating members will be filled in the spaced SP after the mechanical processing.

The light attenuating members may be provided with a light scattering function. Specifically, FIG. 16B shows a light attenuating member 11A made up of attenuating members 11A1 and 11A2 having a refractive index N' each and a light scattering member 11A3 intervening between the two members 11A1 and 11A2. While the attenuating members 11A1 and 11A2 and light scattering member 11A3 are shown as being separate from each other, a material in which a light scattering substance is dispersed may be used to constitute a light attenuating member having a light scattering function. The light scattering member may be provided with a distribution in the direction of output light, e.g., a homogeneous distribution or a Lambert distribution. Such a light scattering member provides output light with a spread without causing it to propagate in one direction, thereby preventing the output light from being condensed.

The light attenuating member with the above-described light scattering function reduces the influence of ghost light. The scattered light returns to the light attenuating member and is further attenuated thereby.

Figure 16A:
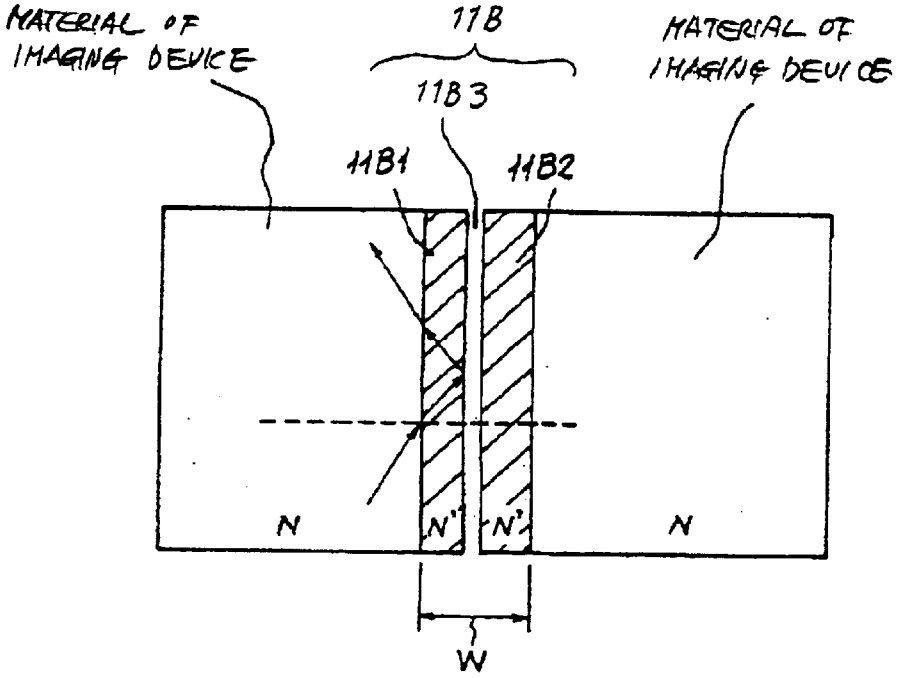
FIGS. 16A and 16B are views each showing a specific configuration of a light attenuating member included in the illustrative embodiment.
Figure 16B:
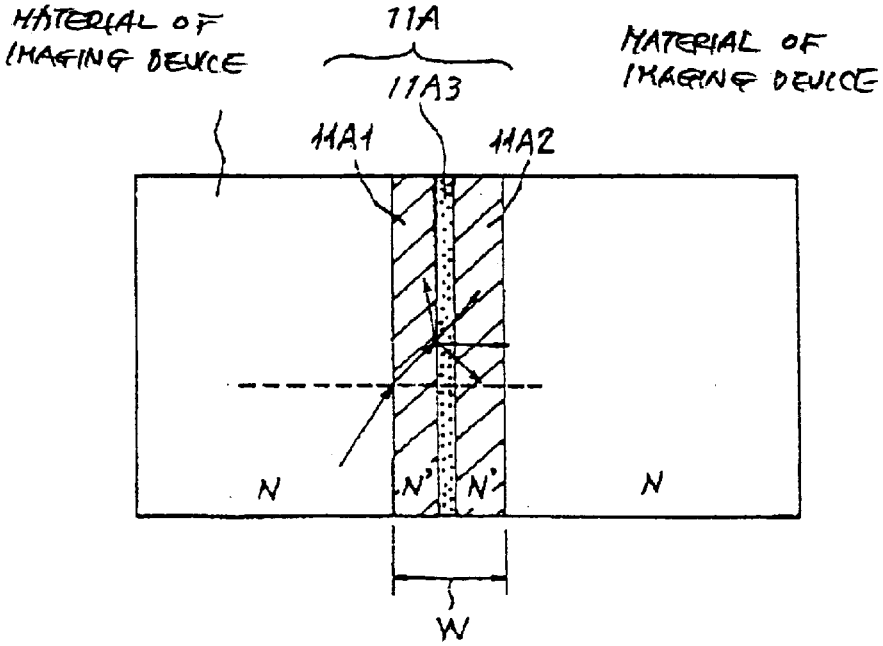

FIG. 16A shows a light attenuating member 11B implemented by light attenuating members 11B1 and 11B2 and an air region 1B3 intervening between the members 11B1 and 11B2. A specific method of forming the air region 11B3 will be described hereinafter. A small tube is inserted into the space SP so as to fill an attenuating member in the space SP via the tube. The tube allows the attenuating member to fully reach the deepest position of the space SP. After the attenuating member has been sufficiently filled in the space SP inclusive of the tube, the tube is pulled out when the attenuating member begins to solidify, leaving an air region.

Another specific method consists in inserting a small plate coated with an attenuating material into the space SP, causing it to contact the inner walls of the space SP to thereby form the attenuating members 11B1 and 11B2, and then forming the air region 11B3 as a movable range of the tube.

The difference between the refractive index of, e.g., 1.5 of the material constituting the attenuating members 11B1 and 11B2 and the refractive index of 1 of air is great. Therefore, a critical angle is about 42 despite the presence of the air region 11B3. Consequently, most of the light incident from the attenuating members 11B1 and 11B2 to the air region 11B3 is totally reflected, returned to the attenuating members, and attenuated thereby. It follows that if the thickness of the air region 11B3 is smaller than the optical path length in the attenuating member 11B, then a scattering effect is achievable without impairing the attenuating effect of the attenuating members.

Figure 17A:
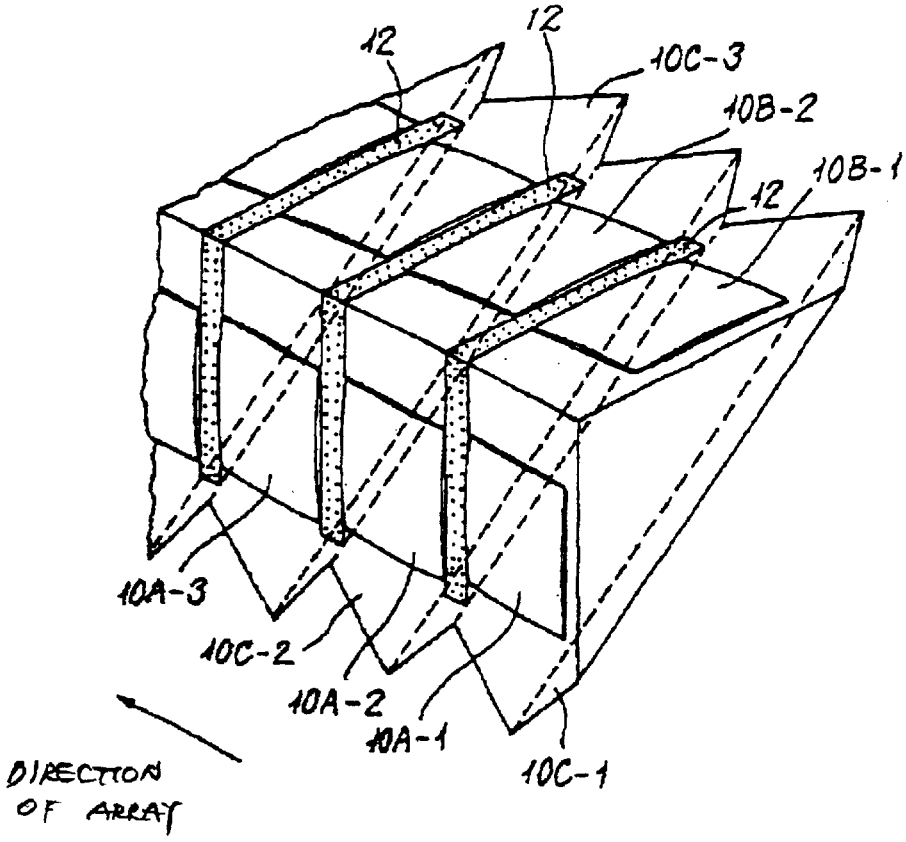
FIGS. 17A and 17B and FIGS. 18A and 18B are views each showing another specific configuration of the light attenuating member.
Figure 17B:
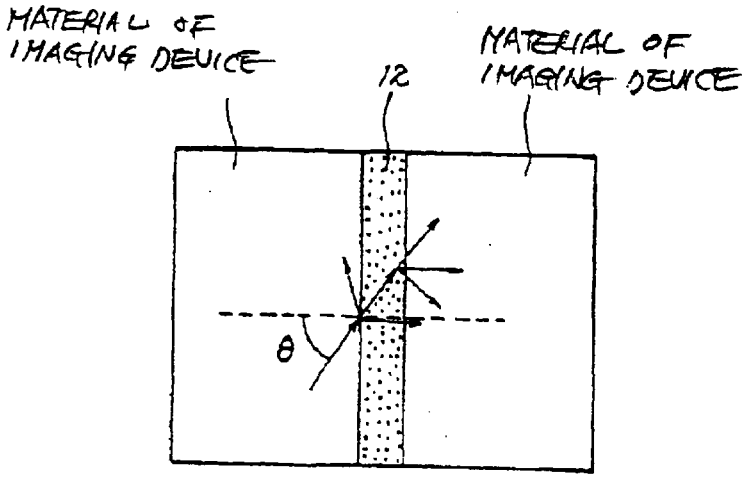

A light scattering member may be used as light attenuating member. FIG. 17A shows a specific configuration of a light scattering member. As shown, a light scattering member 12 is positioned in the space between nearby lens portions. As shown in FIG. 17B similar to FIG. 12B, light incident to the light scattering member 12 is scattered and propagates through a plurality of optical paths. As a result, the energy of the incident light is split into scattered lights. While the direction in which the individual scattered light propagates depends on the scattering characteristic of the scattering member 12, there can be reduced the scattered light tending to propagate between nearby lens portions.

The light scattering member may be produced by the procedure described with reference to FIGS. 14 and 15. The light scattering member is caused to closely contact the boundary between the lens portion and the space to thereby form a boundary between the material of the imaging device and that of the scattering member.

The light attenuating member may be implemented as a light attenuating member intervening between light scattering members in the space between nearby lenses. Specifically, FIG. 12B, which is similar to FIG. 12B, shows light scattering members 12A1 and 12A2 and a light absorbing member 12A3 intervening between the members 12A1 and 12A2 in the above space. The light absorbing member 12A3 plays the role of a light attenuating member. While the scattering members 12A1 and 12A2 and light absorbing member 12A3 are shown as being separate from each other, a light absorbing substance may be mixed with a light scattering member. Because the light attenuating member 12A3 attenuates optical energy, lights scattered by the scattering members 12A1 and 12A2 are split in energy and thereby attenuated. Further, the light absorbing member 12A3 effectively attenuates the energy in accordance with its optical path length.

Figure 18A:
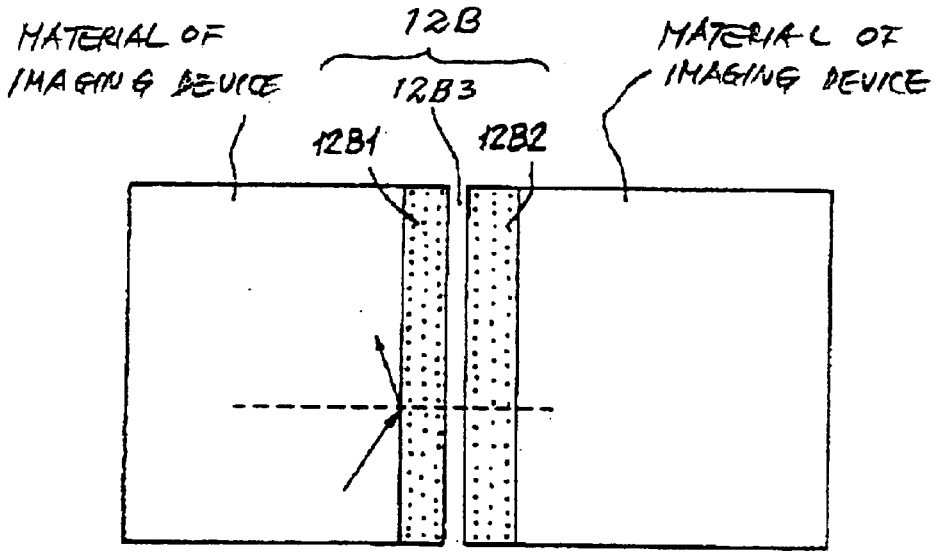
Figure 18B:
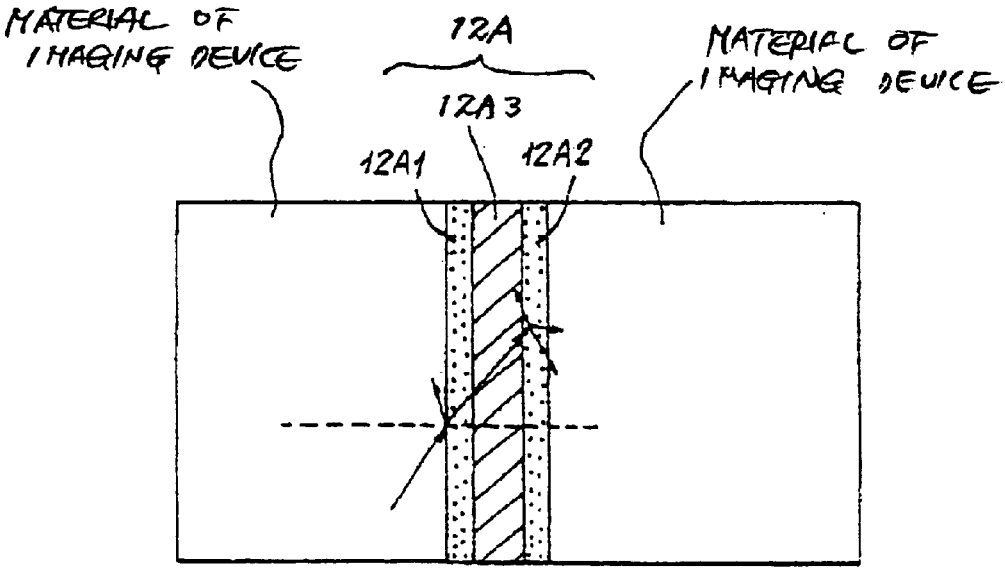

FIG. 18A similar to FIG. 12B shows another specific light scattering member 12B disposed in the space between nearby lens portions. As shown, scattering members 12B1 and 12B2 sandwich an air region 12B3. The air region may be formed in exactly the same manner as described with reference to FIG. 16B. The difference in refractive index between the material of the scattering members 12B1 and 12B2 and air is great. Therefore, most of the light incident from the scattering members to the air region is totally reflected, returned to the scattering members and attenuated thereby despite the presence of the air region 12B3.

Figure 19A:
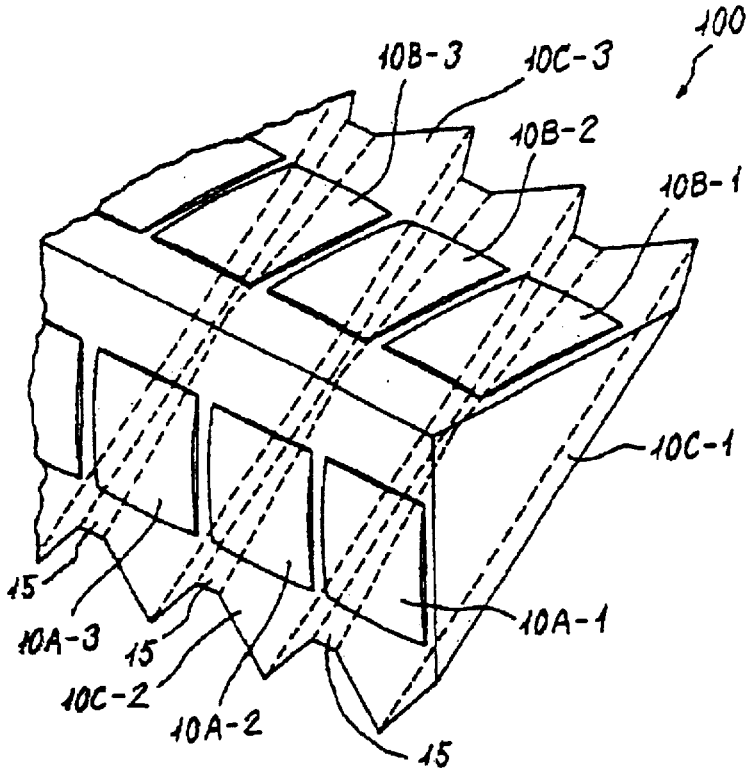
FIGS. 19A and 19B show another specific configuration of the imaging device array of the illustrative embodiment.
Figure 19B:
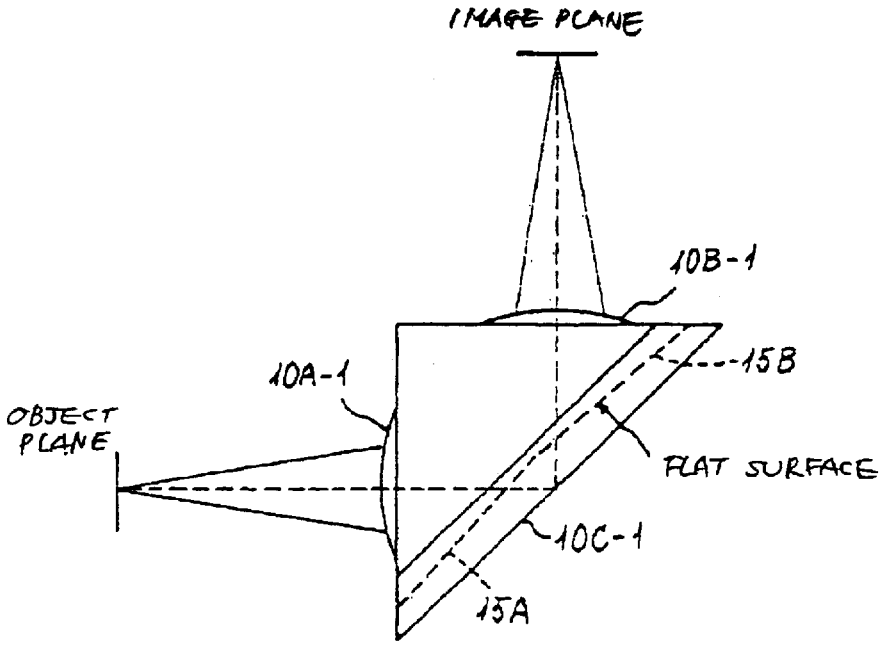

FIGS. 19A and 19B show another specific configuration of the imaging device array of the illustrative embodiment. In the imaging device array 10 described previously, nearby ones of the roof prism portions 10C-1, 10C-2 and so forth adjoin each other via a "valley" whose bottom forms the ridge. By contrast, an imaging device array 100 shown in FIGS. 19A and 19B has a flat surface 15 between nearby roof prisms portions formed by raising the bottom of the above valley. As shown in FIG. 19B, the flat surface 15 is made up of two portions 15A and 15B, as seen in the direction of the array (perpendicular to the sheet surface of FIG. 19B). The two portions 15A and 15B are tapered toward each other in the direction of the ridge of the roof prism 10C-1, as illustrated.

Figure 20:
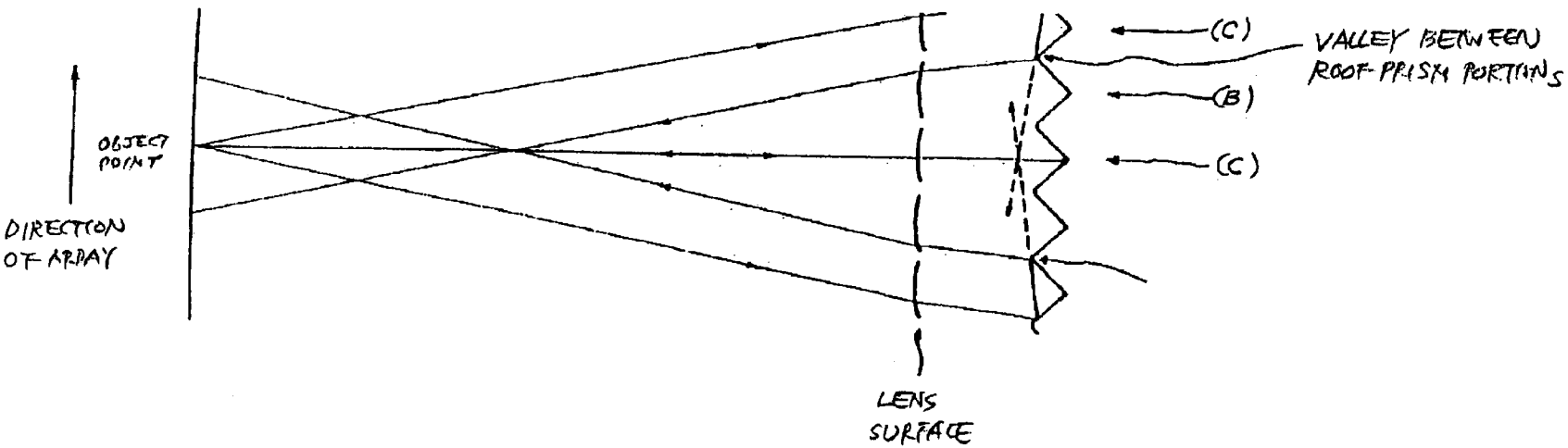
FIG. 20 shows optical paths to appear when the valley of a roof prism portion is raised to form a flat surface.

FIG. 20 is a view similar to FIG. 6, showing optical paths formed when the flat surface 15 is formed between nearby roof prism portions. As shown, light issuing from an object point and incident to the lens surface (first lens surface) of an imaging device (C) is reflected by one prism surface of the roof prism, as illustrated. However, the flat surface 15 prevents the light from being reflected by the other prism surface and causes it to propagate through the imaging device array, as indicated by a dotted arrow in FIG. 20. Such light is therefore not condensed on an image plane as ghost light.

By raising the bottom of the valley between nearby roof prism portions, as stated above, it is possible to further reduce ghost light. Moreover, the two portions 15A and 15B tapered toward each other make it difficult for light reflected thereby to reach an image plane.

A specific optical writing unit practicable with the illustrative embodiment will be described with reference to FIG. 21. As shown, the imaging device array 10 (or 100, FIGS. 19A and 19B) is held by a holder 20 and pressed against a frame 22 by a retainer 21. An LED array or light emitting device array 24 is affixed to the frame 22 and positioned relative to the imaging device array 10. Light issuing from the individual LED of the LED array 24 forms a beam, spot on an image plane, i.e., the surface of a photoconductive element as conventional.

Generally, an LED array has several ten to several hundred LEDs arranged on each of several ten LED array chips, which are mounted on a circuit board. For example, to print an image on a sheet of size A4 with resolution of 600 dpi, 128 LEDs are arranged on each of forty LED array chips, which are mounted on a circuit board. That is, 5,120 LEDs are arranged in total.

Figure 21:
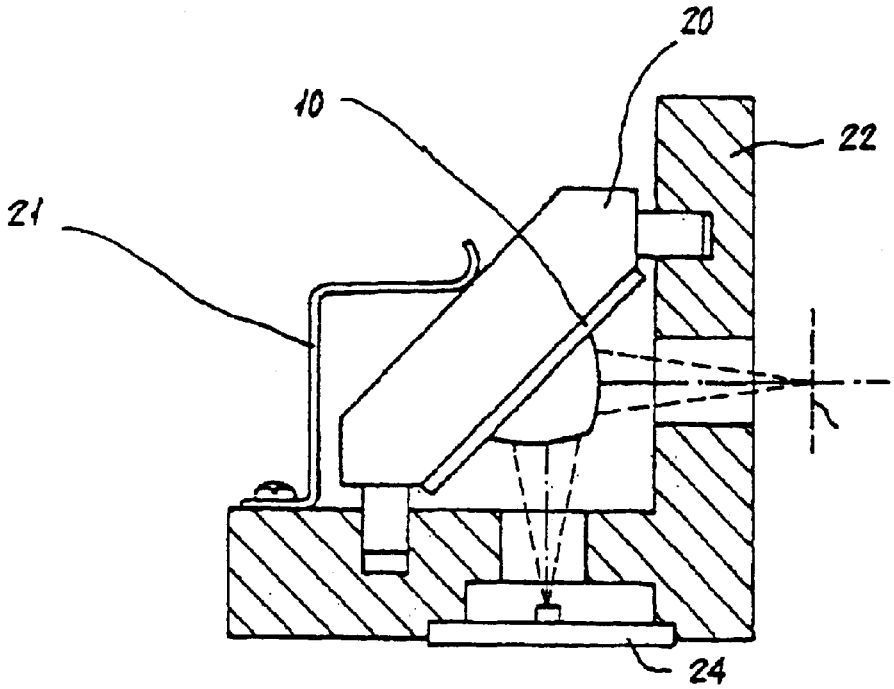
FIG. 21 is a view showing a specific configuration of an optical writing unit using the illustrative embodiment.
Figure 22:
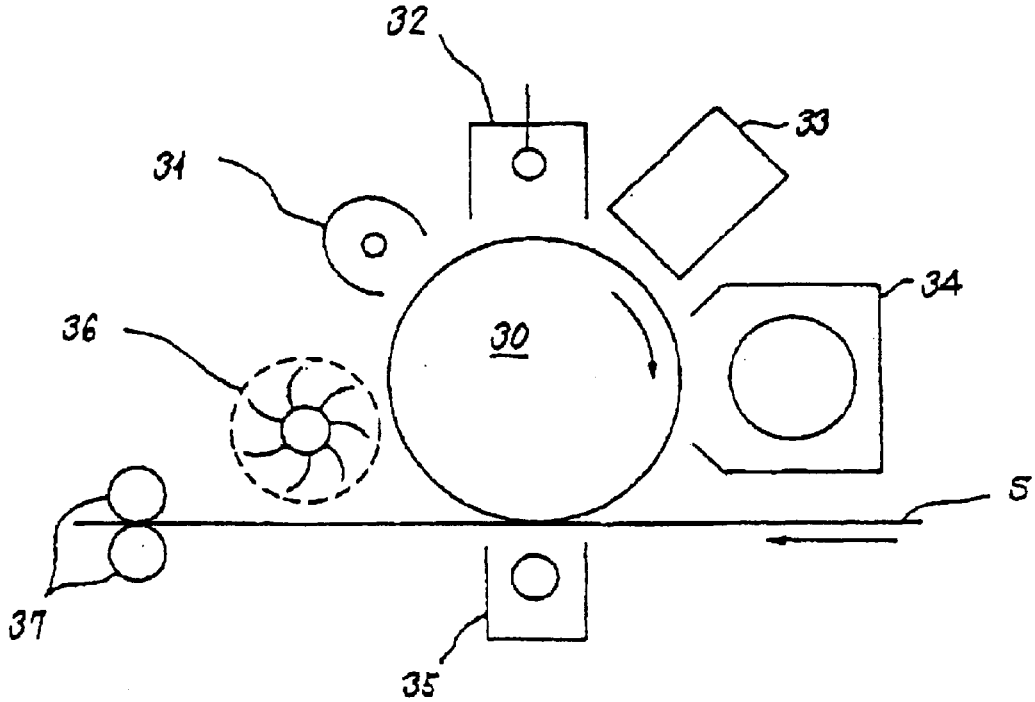
FIG. 22 is a view showing a specific configuration of an image forming apparatus using the illustrative embodiment.

FIG. 22 shows a specific construction of an image forming apparatus embodying the present invention. As shown, the image forming apparatus includes a photoconductive drum 30, which is a specific form of an image carrier. While the drum 30 is rotated clockwise, as viewed in FIG. 22, a charger 32 uniformly charges the surface of the drum 30. An optical writing unit 33 scans the charged surface of the drum 30 with beam spots to thereby form a latent image. A developing unit develops the latent image with toner to thereby form a toner image. The toner image is transferred from the drum 30 to a sheet S and then fixed thereon by a fixing unit 37. After the image transfer, a cleaner unit 36 cleans the surface of the drum 30. A discharging unit 31 then discharges the cleaned surface of the drum 30. The optical writing unit 33 may have the configuration shown in FIG. 21.

Figure 23:
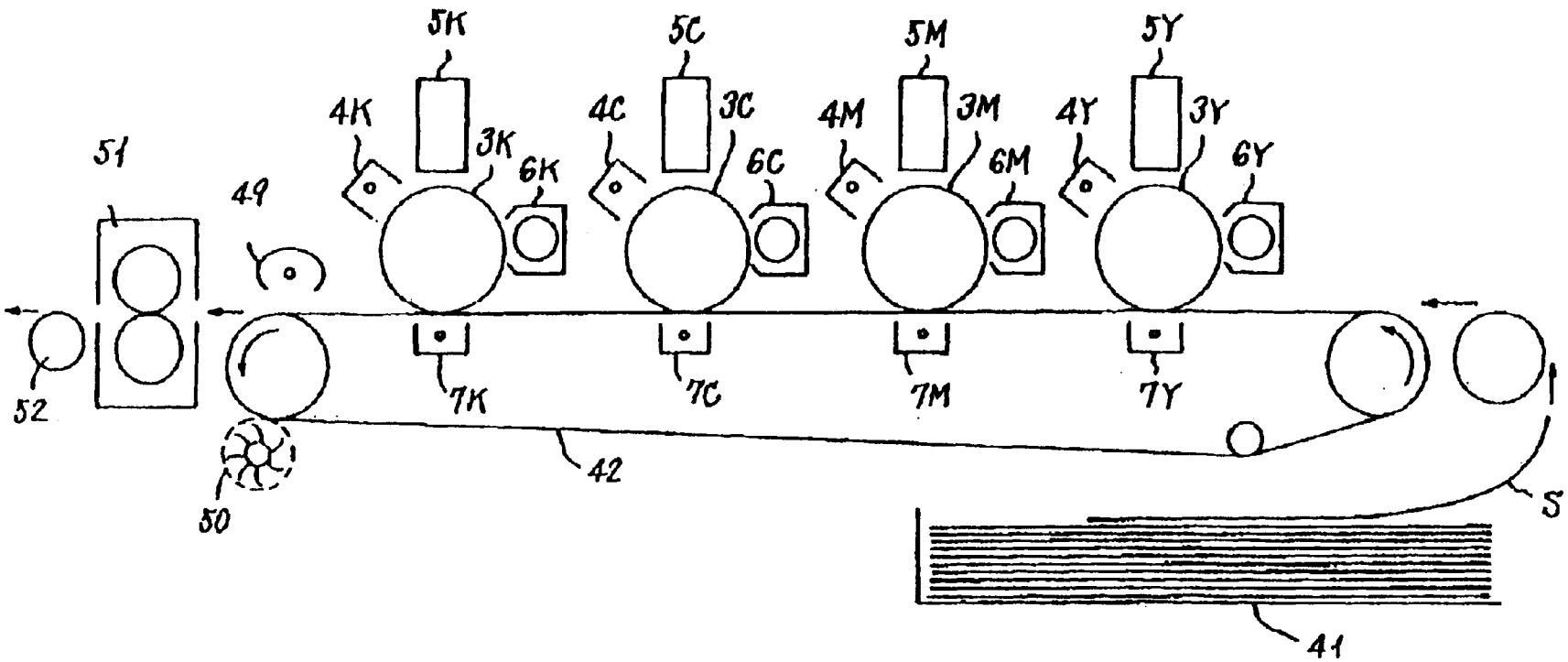
FIG. 23 is a view showing another specific configuration of the image forming apparatus.

FIG. 23 shows a tandem image forming apparatus that is another specific construction of the image forming apparatus embodying the present invention. A tandem image forming apparatus is feasible for high-speed color image formation. As shown, a sheet cassette 41 is positioned at the lower portion of the apparatus. A belt 42 conveys a sheet S fed from the sheet cassette 41. Photoconductive drums 3Y (yellow), 3M (magenta), 3C (cyan) and 3K (black) are sequentially arranged above the belt 42 from the upstream side (right-hand side as viewed in FIG. 23). Process means for effecting an electrophotographic process are arranged around each of the drums 3Y through 3K. More specifically, a charger 4Y, an optical writing unit 5Y, a developing unit 6Y and an image transfer unit 7Y are sequentially arranged around the drum 3Y in this order in the clockwise direction. The process means associated with the other drums 3M through 3K are distinguished from the process means 4Y through 7Y by suffixes M through K.

A discharging unit 49 and a cleaner unit 50 adjoin the belt 42 downstream of the drum 3K in the direction of sheet conveyance. A fixing unit 51 is positioned downstream of the discharging unit 49 in the above direction while an outlet roller 52 is positioned downstream of the fixing unit 51 in the same direction.

In a full-color mode, the optical writing units 5Y through 5K optically form respective latent images in accordance with image data of different colors. Each latent image is developed by toner of corresponding color to become a toner image. The belt 42 conveys the sheet S fed from the sheet cassette 41 while electrostatically retaining it thereon. The toner images are sequentially transferred from the drums 3Y through 3K tot he sheet S one above the other, completing a full-color image. After the fixing unit 51 has fixed the toner image on the sheet S, the sheet is driven out to a tray, not shown, by the outlet roller 52.

In a monochrome mode, only one of the drums 3Y through 3K and process means associated therewith are operated to effect the above-described electrophotographic process. As a result a toner image of desired color is formed on the sheet S.

The optical writing units 5Y through 5K each may have the configuration described with reference to FIG. 21.

Figure 24:
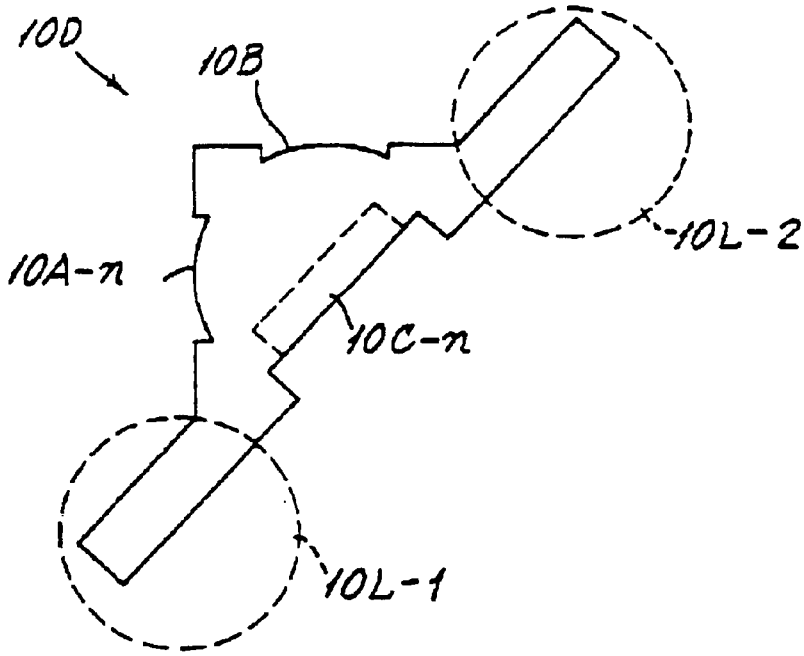
FIG. 24 is a view showing another specific configuration of the imaging device array of the illustrative embodiment.

FIG. 24 shows another specific configuration of the imaging device array of the illustrative embodiment. In FIG. 24, structural elements identical with those of FIG. 12*a* are designated by identical reference numerals. As shown, the imaging device array, generally 10D, includes a first lens surface 10A-n and a second lens surface 10B-n constituting a lens portion. Light is incident to the first lens surface 10A-n and output from the second lens surface 10B-n. The lens portion constitutes a unit imaging device in combination with a roof prism portion 10C-n, which reflects light incident via the first lens surface 10A-n toward the second lens surface 10B-n. A plurality of (n=1, 2, 3, . . . ) unit imaging units are arranged such that the first lens surfaces, second lens surfaces and roof prism portions each are aligned in an array.

Ribs 10L-1 and 10L-2 are respectively formed at the corners where the face of the imaging device array 10D having the first and second lens surfaces 10A-n and 10B-n and the face having the roof prism portions 10C-n join each other. The ribs 10L-1 and 10L-2 extend in the direction in which the unit imaging devices are arranged, guaranteeing the mechanical strength of the imaging device array 10D. Light attenuating means, not shown, intervenes between nearby lens portions for attenuating the intensity of light propagating between the lens portions. The attenuation ratio $\alpha$ of the light attenuating means satisfies the previously stated condition (1), i.e., $\alpha<0.25$.

Figure 25:
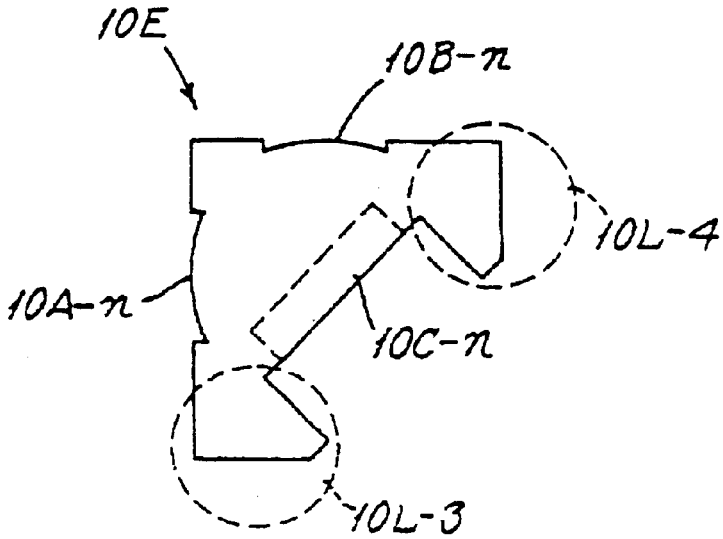
FIG. 25 is a view showing another specific configuration of the imaging device array of the illustrative embodiment.

FIG. 25 shows another specific configuration of the imaging device array of the illustrative embodiment. In FIG. 25, structural elements identical with those of FIG. 12A are designated by identical reference numerals. As shown, the imaging device array, generally 10E, includes a first lens surface 10A-n and a second lens surface 10B-n constituting a lens portion. Light is incident to the first lens surface 10A-n and output from the second lens surface 10B-n. The lens portion constitutes a unit imaging device in combination with a roof prism portion 10C-n, which reflects light incident via the first lens surface 10A-n toward the second lens surface 10B-n. A plurality of (n=1, 2, 3, . . . ) unit imaging units are arranged such that the first lens surfaces, second lens surfaces and roof prism portions each are aligned in an array.

Ribs 10L-3 and 10L-4 are respectively formed at the corners where the face of the imaging device array 10E having the first and second lens surfaces 10A-n and 10B-n and the face having the roof prism portions 10C-n join each other. The ribs 10L-1 and 10L-2 extend in the direction in which the unit imaging devices are arranged, guaranteeing the mechanical strength of the imaging device array 10E. Light attenuating means, not shown, intervenes between nearby lens portions for attenuating the intensity of light propagating between the lens portions. Again, the attenuation ratio $\alpha$ of the light attenuating means satisfies the previously stated condition (1), i.e., $\alpha<0.25$.

In the imaging device array 10D or 10E, one of the ribs 10L-1 and 10L-2 or one of the ribs 10L-3 and 10L-4 may be omitted, if desired. The light attenuating means may have any one of the configurations shown in FIGS. 12*a* and 12B, 16A and 16B, 17A and 17B and 18A and 18B.

Needless light includes flare light in addition to ghost light, as stated earlier. The apertures shown in FIGS. 3A and 3B can effectively reduce or obviate the influence of flare light. The aperture AP2 shown in FIG. 3B is implemented as black ink directly printed or coated on the faces of the imaging device array. Alternatively, the face with the first lens surfaces and/or the face with the second lens surfaces may be processed for light attenuation and/or light scattering except for the lens surfaces. For light attenuation, ink or similar light absorbing substance may be coated, printed or adhered to the above faces. For light scattering, the above faces may be roughened or a material containing fine grains for light scattering may be coated or printed on or adhered to such faces. The aperture AP2 is a kind of processing for light attenuation.

Figure 26:
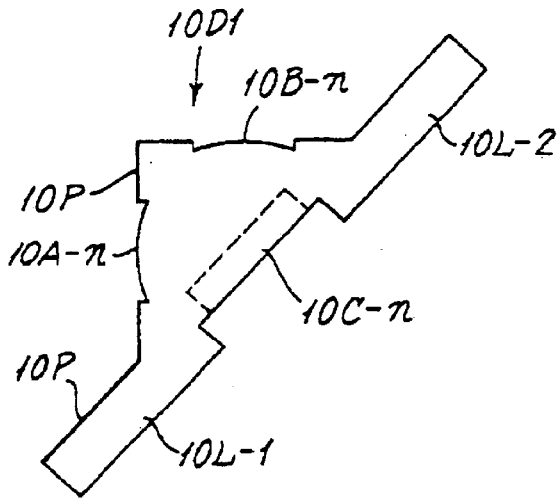
FIG. 26 is a view showing another specific configuration of the imaging device array of the illustrative embodiment.

FIG. 26 shows another specific configuration of the imaging device array of the illustrative embodiment. As shown, the imaging device array, generally 10D1, is similar to the imaging device array 10D of FIG. 24 except for the following. The face of the imaging device array 10D where the first lens surfaces 10A-n are positioned and one surface of the rib 10L-1 contiguous with the above face are processed for light attenuation and/or light scattering by any one of the technologies described above. The processed portion is labeled 10P in FIG. 26. The processed portion 10P effectively attenuates light incident to the imaging device array 10D1 via the first lens surfaces to become flare light, thereby reducing or obviating the influence of flare light.

Figure 27A:
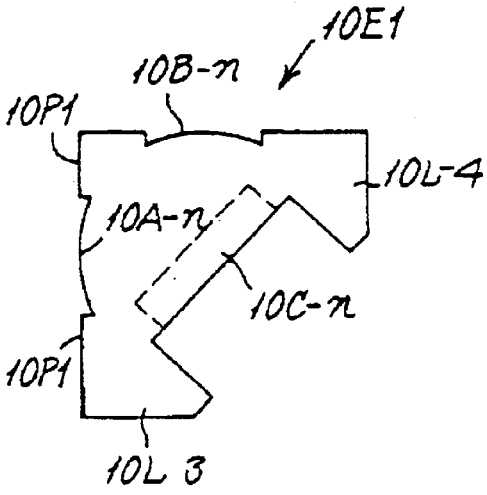
FIGS. 27A and 27B are views showing another specific configuration of the imaging device array of the illustrative embodiment.
Figure 27B:
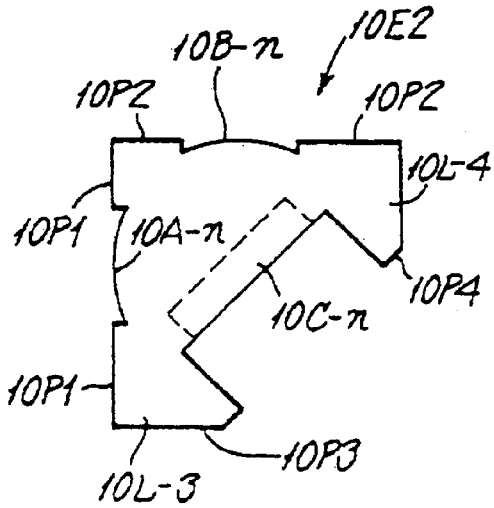

FIGS. 27A and 27B show other specific configurations of the imaging device array of the illustrative embodiment. An imaging device array 10E1 shown in FIG. 27A is similar to the imaging device array 10E of FIG. 24 except that the face of the imaging device array 10E1 where the first lens surfaces 10A-n are positioned and one surface of the rib 10L-3 contiguous with the above face are processed for light attenuation and/or light scattering by any one of the technologies described above. The processed portion is labeled 10P1 in FIG. 27A. The processed portion 10P1 effectively attenuates light incident to the imaging device array 10D1 via the first lens surfaces to become flare light, thereby reducing or obviating the influence of flare light.

An imaging device array 10E2 shown in FIG. 27B is similar to the imaging device array 10E of FIG. 25 except that the face of the imaging device array 10E2 where the first lens surfaces 10A-n are positioned, the face where the second lens surfaces 10B-n are positioned and the face where the roof prism portions 10C-n are positioned are processed, except for the lens surfaces and roof prism portions, for light attenuation and/or light scattering by any one of the technologies described above. The processed portions are labeled 10P1, 10P2, 10P3 and 10P4 in FIG. 27B. The processed portions 10P1 through 10P4 effectively attenuates both of light incident to the imaging device array 10E2 via the first lens surfaces to become flare light and light output from the second lens surfaces to become flare light, thereby reducing or obviating the influence of flare light.

Processing for light attenuation and/or light scattering may be similarly applied to the face with the second lens surfaces (and rib contiguous therewith) of the configuration shown in FIG. 26 or 27A. Also, such processing may be similarly applied to the entire imaging device array of FIG. 26 or 27A except for the first and second lens surfaces and roof prism portions in the same manner as in FIG. 27B.

The optical writing unit shown in FIG. 21 may, of course, use any one of the imaging device arrays 10D, 10E, 10D1, 10E1 and 10E2. Also, the image forming apparatus shown in FIG. 22 or 23 may, of course, use such an optical writing unit.

The array of light emitting portions may be implemented as an LED array, typically a 300 dpi LED array with 300 LEDs arranged for an inch, or an EL array using organic EL devices. Further, use may be made of an optical shutter array made up of a halogen light source and an array of shutters positioned in front of the light source and controlled independently of each other.

The imaging device array may be formed of polycarbonate, PMMA or similar resin for optical devices. While the light attenuating members may be implemented by any suitable material, e.g., ink, use may be made of the same material as the imaging device array, but containing carbon black for increasing the internal absorption ratio k'.

Second Embodiment

Figure 28A:
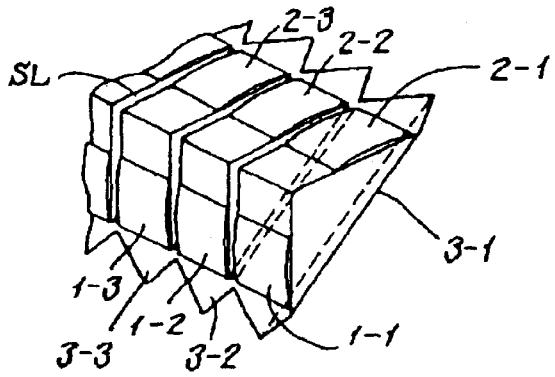
FIGS. 28A through 28C are views showing a second embodiment of the imaging device array in accordance with the present invention.
Figure 28B:
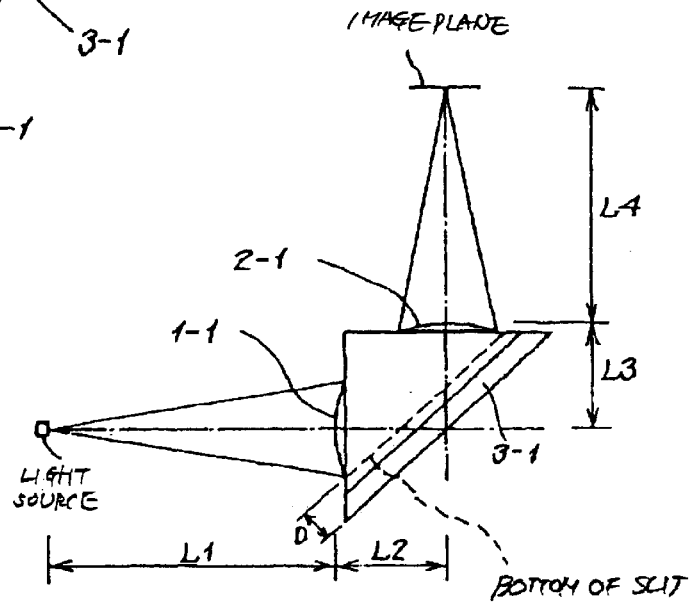
Figure 28C:
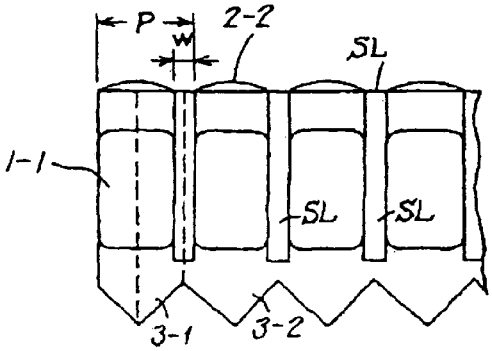

Reference will be made to FIGS. 28A through 28C for describing an alternative embodiment of the present invention. In the conventional imaging device array shown in FIGS. 8A, 8B and 9, the slits SL are formed from the ridge between the first lens array and the roof prism array toward the second lens array. In the illustrative embodiment, as shown in FIG. 28A, slits SL each having a rectangular section are formed between nearby lens portions from the ridge between the first lens array (first lens surfaces 1-1, 1-2 and so forth) and the second lens array (second lens surfaces 2-1, 2-2 and so forth) toward the roof prism array (roof prisms 3-1, 3-2 and so forth).

Assume that the distance between the bottom of each slit SL and the ridge of the roof prism is D (see FIG. 28B) that the pitch of the lens portions is P, and that the width of each slit is W (see FIG. 28*c*). Then, in the illustrative embodiment the following relation is selected:

$$P/2<D<P/2+0.7\sqrt{(W)} \quad (21)$$

The walls of the slits SL are processed for reducing reflection. The imaging device array may be produced by molding.

In the conventional imaging device array shown in FIGS. 8A, 8B and 9, assume that the distance L3, i.e., the optical path length over which main light incident to the array is reflected by the roof prism 3-1 and then output from the second lens surface is short. Then, the width t over which the slit is not formed should be relatively reduced, reducing the mechanical strength of the entire imaging device array. By contrast, in the illustrative embodiment, the distance D between the bottom of the slit SL and the ridge of the roof prism does not have to be varied, so that the imaging device array has sufficient mechanical strength.

The walls of each slit SL processed for reducing reflection obviate the influence of light reflected thereby. However, as shown in FIG. 29 similar to FIG. 4, ghost light sometimes appears due to light incident to a lens B, reflected by a roof prism B associated with the lens B, propagated between the bottom of the slit and that of the roof prism B and then output from a lens A and light incident to the lens B, propagated between the bottom of the slit and that of the roof prism, reflected by a roof prism C and then output from a lens C.

Figure 29:
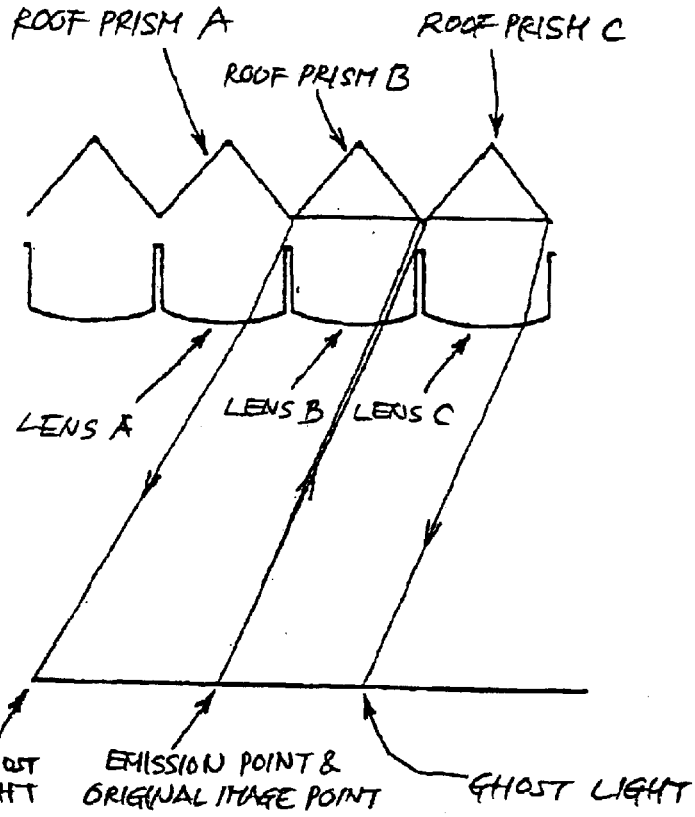
FIG. 29 shows ghost light that the second embodiment can effectively reduce.
Figure 30:
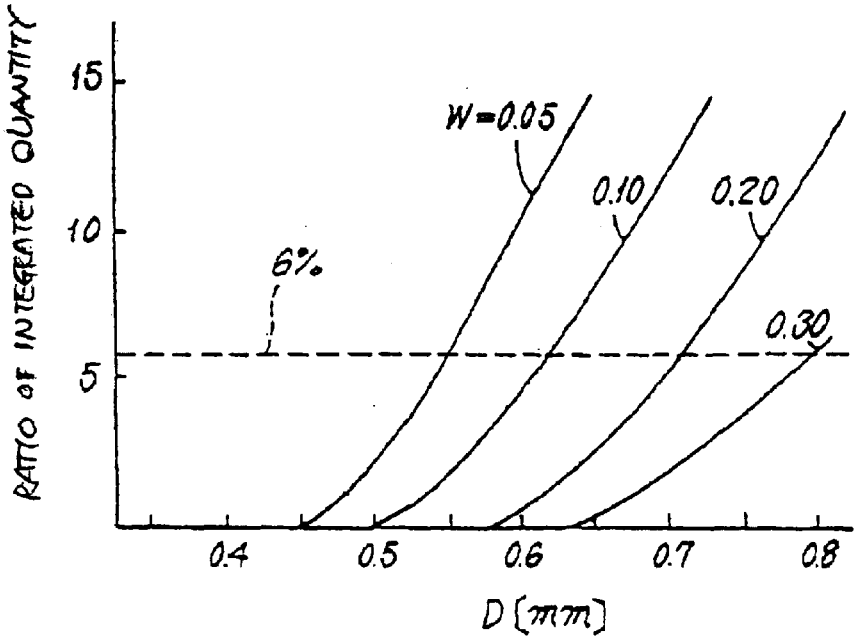
FIG. 30 is a graph showing a relation between the configuration of a slit and ghost light.

We experimentally determined with an image forming apparatus that ghost light of the kind shown in FIG. 29 had no influence on images if the integrated quantity of ghost light was 5% to 6% of the quantity of expected light. We then determined by simulation the configuration of the slit that confined the integrated quantity of ghost light in the above range by using the configuration as a parameter. FIG. 30 shows the result of simulation. For the simulation, use was made of an LED as a light source having a Lambert distribution.

As shown in FIGS. 28B and 28C, the distance between the light source and the lens surface is L1. The distance on the optical axis between the lens surface at the incidence side and the ridge of the roof prism is L2. The distance on the optical axis between the lens surface at the output side and the ridge of the roof prism is L3. The distance between the lens surface at the output side and the image plane is L4. The distance between nearby lens portions is P. The aperture of each lens in the axial direction of the trigonal prism is APx while the aperture of each lens in the direction perpendicular to the axial direction is APy. For the simulation, such parameters were selected as follows:

| | |
|---|---|
| L1 and L4 | 8 mm |
| L2 and L3 | 1.45 mm |
| P | 0.8 mm |
| Apx | 0.7 mm |
| Apy | 0.0 mm |

Further, the radius of curvature of each lens surface was optimized such that an output image is 1.025 times as great as an incident image.

FIG. 30 shows a relation between the integrated quantity of light (ordinate) and the distance D (abscissa) between the bottom of the slit and the ridge of the roof prism. Because the precondition is that the integrated quantity of ghost light is substantially 5% to 6% of the expected light, as stated earlier, a distance D implementing such an integrated quantity is determined. Assuming that the integrated quantity of ghost light is 6%, then the distance D is 0.56 mm when W is 0.5 mm, 0.62 mm when W is 1.0 mm, 0.72 mm when W is 2.0 mm or 0.79 mm when W is 3.0 mm. Therefore, if W is equal to or less than the above value, then the imaging device array achieves sufficient performance.

FIG. 30 gives the relation between the distance D and the slit width W:

$$D<P/2+0.7\times\sqrt{W} \tag{22}$$

The influence of ghost light can therefore be obviated if the slit configuration (W and D) satisfies the above relation (22). More specifically, experiments showed that the relation (22) held even when the parameters for simulation were varied. For example, when P was 1.0 mm and W was 0.1 mm (APx=0.9 mm), the integrated quantity of light was 4% when D was 01.7 mm (no influence of ghost light on images) or 9% when D was 0.80 mm (influence of ghost light on images). Further, when L1 and L4 were 10 mm and W was 0.1 mm, the integrated quantity of light was 4% when D was 0.6 mm (no influence of ghost light on images) or 7% when D was 0.65 mm (influence of ghost light on images).

When D is reduced to P/2, the imaging device array is divided into the unit imaging devices and cannot be molded integrally. Therefore, D should satisfy the previously stated relation (21).

Figure 31A:
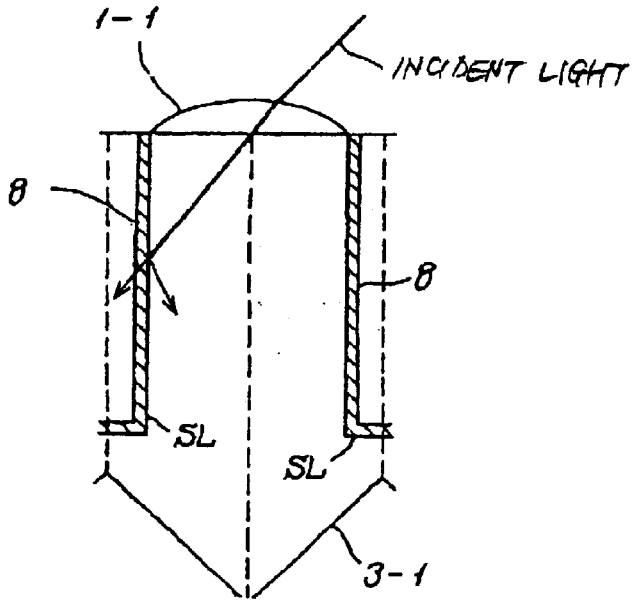
FIGS. 31A and 31B are views each showing specific processing applied to the walls of a slit for reducing internal reflection.

FIG. 31A shows a specific scheme for processing the walls of each slit SL in order to reduce reflection. As shown, the entire walls of the slit SL are coated with a black or similar paint for absorbing light. A black substance absorbs light in the visible range. Because light to issue from LEDs in general is visible light, light incident to the walls of the slit SL is absorbed by the paint, i.e., an absorption film 8 and reflected little. The paint may be replaced with a black or similar member, e.g., silicone rubber filled in the slit SL, in which case the member must closely contact the walls of the slit.

Figure 31B:
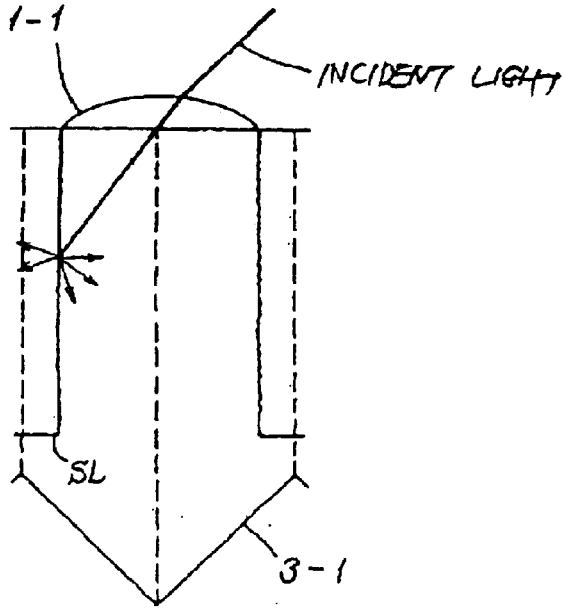

FIG. 31B shows another specific scheme for processing the walls of the slit SL. As shown, light incident to the walls of the slit SL is subjected to diffused reflection with the result that light subjected to reflection is reduced. Most of the light subjected to diffused reflection is reflected into the imaging device array or scattered into the slit SL, so that little light is output from the lens surface to become ghost light. If desired, the light absorption processing shown in FIG. 31A maybe used in addition to roughening for further enhancing the above effect.

Figure 32:
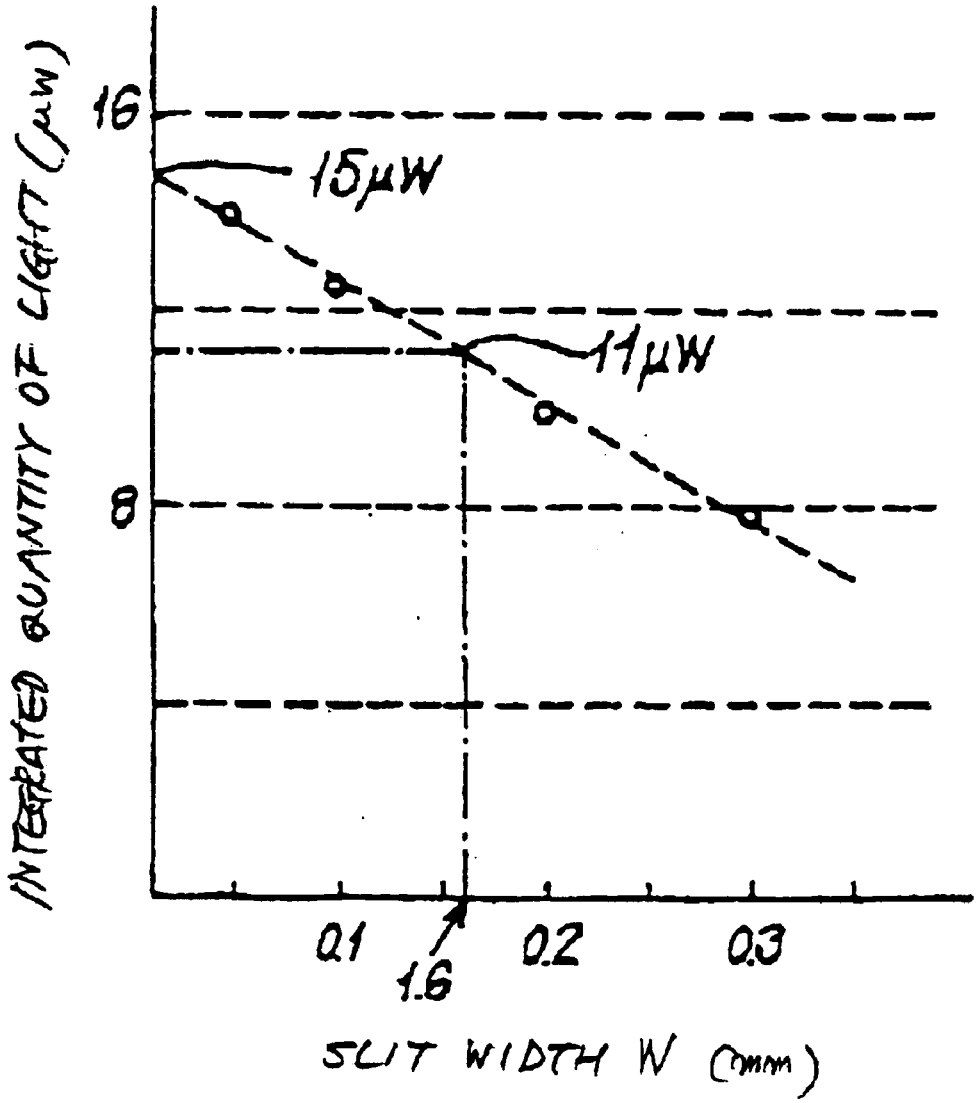
FIG. 32 is a graph showing a relation between the slit width and the integrated quantity of imaging light.

FIG. 32 shows a relation between the width W of the slit (abscissa) and the integrated quantity of imaging light or expected light (ordinate). As shown, the integrated quantity of light decreases with an increase in width W. This indicates that the slit width should preferably be small enough to implement a sufficient integrated quantity of light.

More than 70% of an integrated quantity of light obtainable without a slit can be guaranteed despite the slit if the relation (21) and the following relation are satisfied:

$$W<0.2 \tag{23}$$

When the slit width W is determined in accordance with the relation (23), the lens aperture APx in the direction of the array is expressed as:

$$Apx=P-W\geqq 0.8\times P \tag{24}$$

In this case, while the lens aperture APy in the direction perpendicular to the array is not limited, it should preferably be greater than the lens aperture APx in order to achieve a sufficient quantity of light, i.e.:

$$APy>APx \tag{25}$$

However, if the lens aperture APy is excessively great, then the diameter of a beam spot on the image plane increases and lowers the imaging ability of the imaging device array. The beam spot diameter in the direction perpendicular to the array can be reduced to 1.5 times the beam spot diameter in the direction of the array or less if the lens aperture APy satisfies a relation:

$$APy<0.2\times L1 \quad (26)$$

Assuming that the maximum light intensity of the beam spot is 1, then the beam spot diameter refers to a beam spot width when the light intensity is $1/e^2$. We confirmed by experiments that the above ratio of the beam spot diameter did not influence images output by an image forming apparatus. More specifically, the lens aperture APy should preferably satisfy a relation:

$$0.8P<APy<0.2L1 \quad (27)$$

Figure 33A:
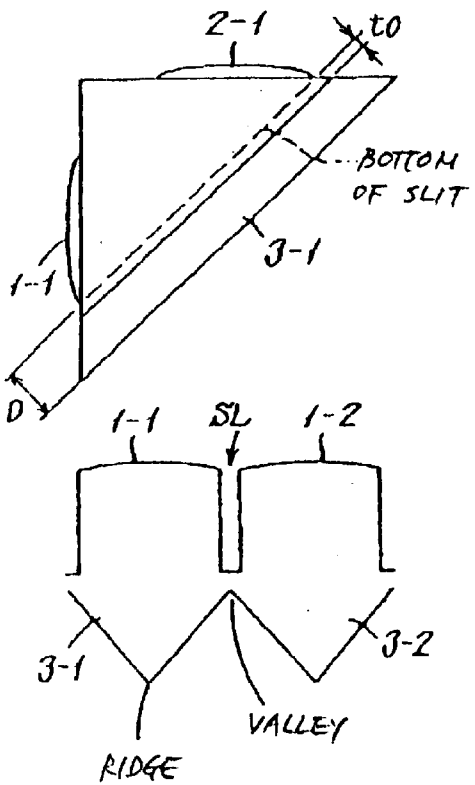
FIGS. 33A through 33C are views each showing a specific configuration of valleys included in a roof prism array.

As shown in FIG. 33A, the thickness $t_o$ of the imaging device array decreases at a position where the slit is formed. By contrast, as shown in FIG. 33B, the thickness can be increased to t' without effecting the imaging light if the bottom 3-10A of the roof prism array, which is at the back of the bottom of the slit SL, is raised in a flat configuration.

Further, most of ghost light is reflected in the vicinity of the bottom of the roof prism array, i.e., between the ridges. Therefore, raising the bottom of the roof prism array is successful to further reduce ghost light. For example, when D and W, which are included in the previously mentioned parameters for simulation, were 0.6 mm and 0.1 mm, respectively, and when the bottom was not raised, the integrated quantity of light was 5%. On the other hand, when the bottom was raised, the integrated quantity of light was reduced to 1% with the imaging light remaining substantially the same. The problem with the raised bottom is that it forms a flat surface 3-10A, as shown in FIG. 33B, and is apt to reflect light. To solve this problem, it is preferable to form an absorption film on the flat surface or roughen the flat surface for thereby reducing reflection.

Figure 33B:
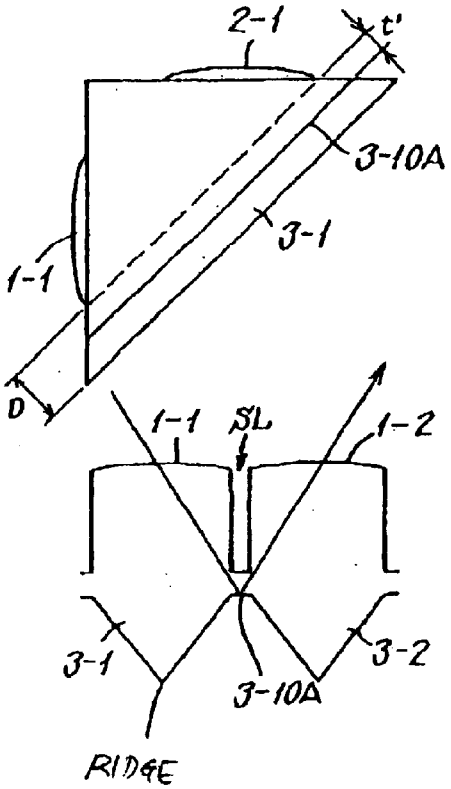
Figure 33C:
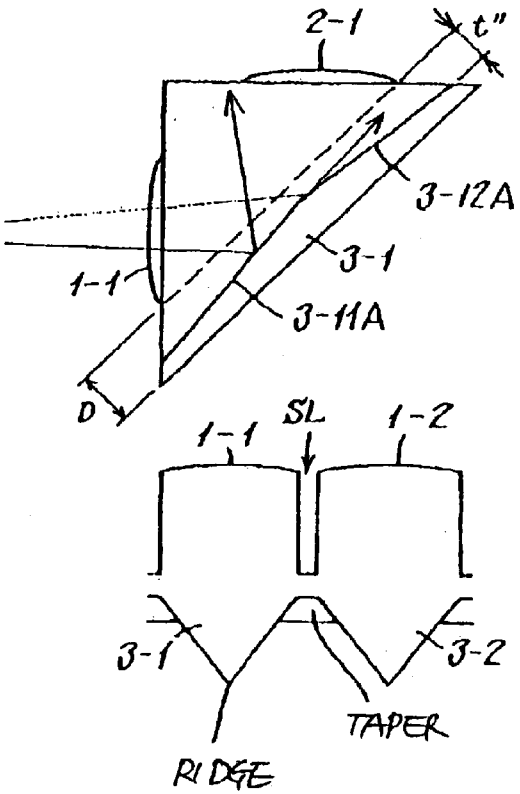

As shown in FIG. 33C, the raised bottom of the roof prism array may be made up of two flat surfaces 3-11A and 3-12A tapered toward each other. This configuration releases light reflected by the flat surfaces 3-11A and 3-12A to the outside of the imaging device array.

When the bottom of the roof prism array is raised, as shown in FIG. 33B or 33C, assume that the width of the raised flat surface in the direction of the array (minimum width in the case of the tapered flat surface) is K. Then, the lower limit of the distance D can be reduced to (P−K)/2. Assuming K≦W, then the lower limit can be reduced to (P−W)/2.

Figure 34A:
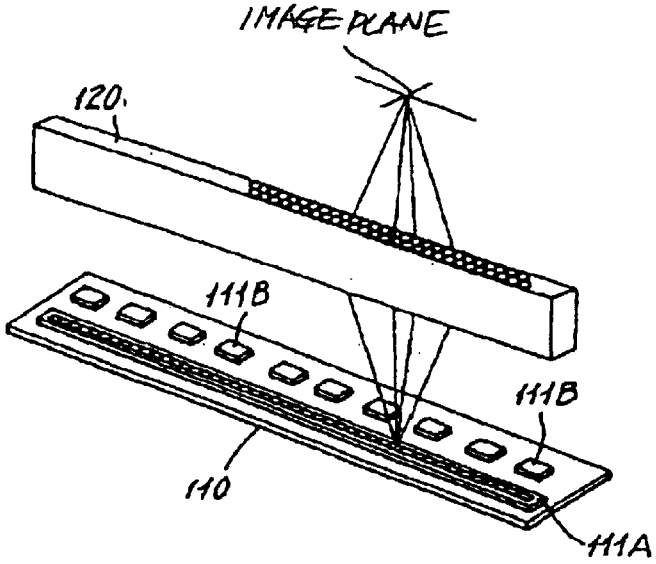
FIGS. 34A through 34C are views showing a conventional optical writing unit.
Figure 34B:
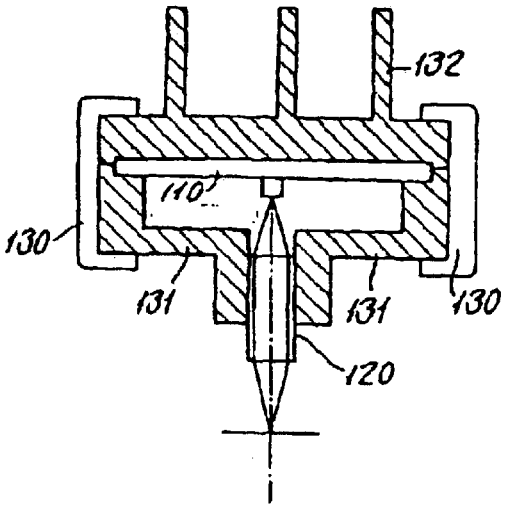
Figure 34C:
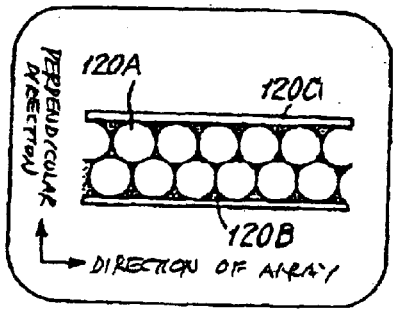

FIGS. 34A through 34C show a conventional optical writing unit of the type using an imaging device array. As shown, the optical writing unit includes a light emitting portion array 110 implemented as an LED array and an imaging device array 120 implemented as a rod lens array. The LED array 110 has a number of LEDs 111A arranged in one direction at preselected intervals. A driver 11B selectively turns on or turns off the individual LEDs 111A. A typical LED array has resolution of 300 dpi, i.e., 300 LEDs for an inch or resolution of 600 dpi.

As shown in FIG. 34C, the rod lens array 120 has refraction distribution type of rod lenses 120A arranged in staggered arrays. Gaps between the rod lenses 120A are filled with an opaque member 120B. The rod lenses 120A and opaque member 120B are assembled together by side walls 120C.

As shown in FIG. 34B, holders 131 and 132 support the LED array 110 and rod lens array 120 and are affixed to a frame 130. The problem with this type of optical writing unit is that the positions and sizes of beam spots become irregular if the rod lenses are accurately positioned, as well known in the art.

The imaging device array of the illustrative embodiment is also applicable to the optical writing unit, FIG. 21, or the image forming apparatus, FIGS. 22 and 23, of the first embodiment. Also, the imaging device array shown in FIGS. 24, 25, 26, 27A and 27B is similarly applicable to the illustrative embodiment.

Various modifications will become possible for those skilled in the art after receiving the teachings of the present disclosure without departing from the scope thereof.

What is claimed is:

1. An imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens surface toward said second lens surface, said plurality of unit imaging devices being arranged integrally with each other such that first lens surfaces, second lens surfaces and roof prism portions each are arranged in a respective array; and light attenuating means each intervening between nearby lens portions for attenuating light propagating between said nearby lens portions;

wherein said light attenuating means has an attenuation ratio α smaller than 0.25.

2. The array as claimed in claim 1, wherein said light attenuating means each comprise a light attenuating member having a width W in a direction of arrangement of said unit imaging devices, and assuming that a material constituting said array has a refractive index N and an internal absorption ratio k, and that a material constituting said light attenuating member has a refractive index N' and an internal absorption ratio k', then W, N, N', k and k' satisfy relations:

$$N'\geqq N$$

$$(k'-k)>0.43/W.$$

3. The array as claimed in claim 2, wherein a ratio ΔN of a difference in refractive index between said imaging device array to said light attenuating member (ΔN=(N'−N)/N)) satisfies a relation:

$$0\leqq\Delta N\leqq 0.05.$$

4. The array as claimed in claim 1, wherein said light attenuating means comprises a space formed between said nearby lens portions and a light attenuating member filling said space.

5. The array as claimed in claim 4, wherein said light attenuating means has a light scattering function.

6. The array as claimed in claim 4, wherein said space comprises an air region.

7. The array as claimed in claim 1, wherein said light attenuating means comprises a light scattering member.

8. The array as claimed in claim 7, further comprising a space formed between said nearby lens portions and filled with said light scattering member.

9. The array as claimed in claim 8, wherein said light scattering member contains a light attenuating member.

10. The array as claimed in claim 8, wherein said space comprises an air region.

11. The array as claimed in claim 1, wherein a bottom of a valley portion between nearby roof prism portions is raised to form a flat surface.

12. An optical writing unit comprising:

a light emitting portion array comprising a plurality of fine light emitting portions arranged in an array; and an imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens surface toward said second lens surface, said plurality of unit imaging devices being arranged integrally with each other such that first lens surfaces, second lens surfaces and roof prism portions each are arranged in a respective array; and light attenuating means each intervening between nearby lens portions for attenuating light propagating between said nearby lens portions;

wherein said light attenuating means has an attenuation ratio $\alpha$ smaller than 0.25.

13. An image forming apparatus comprising an optical writing unit for writing an image on a photoconductive element to thereby form an image, wherein said optical writing unit comprises:

a light emitting portion array comprising a plurality of fine light emitting portions arranged in an array; and an imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens surface toward said second lens surface, said plurality of unit imaging devices being arranged integrally with each other such that first lens surfaces, second lens surfaces and roof prism portions each are arranged in a respective array; and light attenuating means each intervening between nearby lens portions for attenuating light propagating between said nearby lens portions;

wherein said light attenuating means has an attenuation ratio $\alpha$ smaller than 0.25.

14. An imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens surface toward said second lens surface, said plurality of unit imaging devices being arranged integrally with each other such that first lens surfaces, second lens surfaces and roof prism portions each are arranged in a respective array;

a rib formed at a corner where at least one of a face of said imaging device array where said first lens surface is positioned and a face where said second lens surface is positioned and a face where said roof prism portion is positioned join each other, said rib extending in a direction of arrangement of said unit imaging devices for guaranteeing mechanical strength; and light attenuating means each intervening between nearby lens portions for attenuating light propagating between said nearby lens portions;

wherein said light attenuating means has an attenuation ratio $\alpha$ smaller than 0.25.

15. An imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens surface toward said second lens surface, said plurality of unit imaging devices being arranged integrally with each other such that first lens surfaces, second lens surfaces and roof prism portions each are arranged in a respective array, wherein at least one of a face of said imaging device array where said first lens surface is positioned and a face where said second lens surface is positioned is processed for at least one of light attenuation and light scattering except for said first lens surface and said second lens surface; and light attenuating means each intervening between nearby lens portions for attenuating light propagating between said nearby lens portions;

wherein said light attenuating means has an attenuation ratio $\alpha$ smaller than 0.25.

16. The array as claimed in claim 15, further comprising a rib formed at a corner where at least one of a face of said imaging device array where said first lens surface is positioned and a face where said second lens surface is positioned and a face where said roof prism portion is positioned join each other, said rib extending in a direction of arrangement of said unit imaging devices for guaranteeing mechanical strength.

17. An imaging device array comprising:

a single transparent trigonal prism;

a first lens array comprising a plurality of optically equivalent first lens surfaces arranged on a first face of said trigonal prism in an array in an axial direction;

a second lens array comprising a plurality of optically equivalent second lens surfaces arranged on a second face of said trigonal prism in an array in the axial direction in one-to-one correspondence to said plurality of said first lens surfaces;

a roof prism array comprising a plurality of optically equivalent roof prisms arranged on a third face of said trigonal prism in the axial direction with ridges extending perpendicularly to said axial direction;

a plurality of unit imaging devices each comprising one of said first lens surfaces, one of said second lens surfaces and one of said roof prisms corresponding to each other; and a slit formed between nearby ones of pairs of said first lens surfaces and said second lens surfaces to thereby separate said pairs from each other, said slit having a rectangular section extending from a ridge between said first lens array and said second lens array toward said third face perpendicularly to the axial direction;

wherein a distance D between a bottom of said slit and the ridge of said roof prism, a distance P between said pairs of said first lens surfaces and said second lens surfaces and a width W of said slit satisfy a relation:

$$P/2<D<P/2+0.7\sqrt{(W)}.$$

18. The array as claimed in claim 17, wherein walls of said slit are processed for light absorption to thereby reduce internal reflection.

19. The array as claimed in claim 17, wherein walls of said slit are processed for light scattering to thereby reduce internal reflection.

20. The array as claimed in claim 17, wherein the width W is smaller than 0.2 P.

21. The array as claimed in claim 20, wherein an aperture APy of each of said first lens surfaces and said second lens surfaces in the axial direction is in a range:

$$0.8P<APy<0.2L1$$

where P denotes a distance between said pairs of said first lens surfaces and said second lens surfaces, and L1 denotes a distance between a light source and said first lens array.

22. The array as claimed in claim 17, wherein nearby ones of said roof prisms join each other via a flat connecting surface.

23. The array as claimed in claim 17, wherein said array comprises a single molding of resin.

24. An optical writing unit comprising:

a light emitting portion array comprising a plurality of fine light emitting portions arranged in an array; and an imaging device array for focusing light incident from said light emitting portion array on a writing surface;

said imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens toward said second lens surface, said plurality of unit imaging devices being arranged integrally with each other such that first lens surfaces, second lens surfaces and roof prism portions each are arranged in a respective array;

a rib formed at a corner where at least one of a face of said imaging device array where said first lens surface is positioned and a face where said second lens surface is positioned and a face where said roof prism portion is positioned join each other, said rib extending in a direction of arrangement of said unit imaging devices for guaranteeing mechanical strength; and light attenuating means each intervening between nearby lens portions for attenuating light propagating between said nearby lens portions;

wherein said light attenuating means has an attenuation ratio a smaller than 0.25.

25. An image forming apparatus comprising an optical writing unit for writing an image on a photoconductive element to thereby form an image, wherein said optical writing unit comprises:

a light emitting portion array comprising a plurality of fine light emitting portions arranged in an array; and an imaging device array for focusing light incident from said light emitting portion array on a writing surface;

said imaging device array comprising:

a plurality of unit imaging devices each comprising a lens portion made up of a first lens surface to which a light beam for imaging is incident and a second lens surface from which said light beam is output, and a roof prism portion for reflecting said light beam incident via said first lens toward said second lens surface, said plurality of unit imaging devices being arranged integrally with each other such that first lens surfaces, second lens surfaces and roof prism portions each are arranged in a respective array;

a rib formed at a corner where at least one of a face of said imaging device array where said first lens surface is positioned and a face where said second lens surface is positioned and a face where said roof prism portion is positioned join each other, said rib extending in a direction of arrangement of said unit imaging devices for guaranteeing mechanical strength; and light attenuating means each intervening between nearby lens portions for attenuating light propagating between said nearby lens portions;

wherein said light attenuating means has an attenuation ratio $\alpha$ smaller than 0.25.

26. An imaging device array comprising:

a single transparent trigonal prism;

a first lens array comprising a plurality of optically equivalent first lens surfaces arranged on a first face of said trigonal prism in an array in an axial direction;

a second lens array comprising a plurality of optically equivalent second lens surfaces arranged on a second face of said trigonal prism in an array in the axial direction in one-to-one correspondence to said plurality of first lens surfaces;

a roof prism comprising a plurality of optically equivalent roof prisms arranged on a third face of said trigonal prism in the axial direction with ridges extending perpendicularly to said axial direction;

a plurality of unit imaging devices each comprising one of said first lens surfaces, one of said second lens surfaces and one of said roof prisms corresponding to each other; and a slit formed between nearby ones of pairs of said first lens surfaces and said second lens surfaces to thereby separate said pairs from each other, said slit having a rectangular section extending from a ridge between said first lens array and said second lens array toward said third face perpendicularly to the axial direction, wherein walls of said slit are processed for reducing internal reflection such that a distance D between a bottom of said slit and the ridge of said roof prism, a distance P between said pairs of said first lens surfaces and said second lens surfaces and a width W of said slit satisfy a relation:

$$P/2<D<P/2+0.7\sqrt{(W)}; \text{ and}$$

a rib formed at a corner where at least one of a face of said imaging device array where said first lens array is positioned and a face where said second lens array is positioned and a face where said roof prism array is positioned join each other, said rib extending in a direction of arrangement of said unit imaging devices for guaranteeing mechanical strength.

27. An imaging device array comprising:

a single transparent trigonal prism;

a first lens array comprising a plurality of optically equivalent first lens surfaces arranged on a first face of said trigonal prism in an array in an axial direction;

a second lens array comprising a plurality of optically equivalent second lens surfaces arranged on a second face of said trigonal prism in an array in the axial direction in one-to-one correspondence to said plurality of first lens surfaces;

a roof prism array comprising a plurality of optically equivalent roof prisms arranged on a third face of said trigonal prism in the axial direction with ridges extending perpendicularly to said axial direction;

a plurality of unit imaging devices each comprising one of said first lens surfaces, one of said second lens surfaces and one of said roof prisms corresponding to each other;

a slit fanned between nearby ones of pairs of said first lens surfaces and said second lens surfaces to thereby separate said pairs from each other, said slit having a rectangular section extending from a ridge between said first lens array and said second lens array toward said third face perpendicularly to the axial direction, wherein walls of said slit are processed for reducing internal reflection such that a distance D between a bottom of said slit and the ridge of said roof prism, a distance P between said pairs of said first lens surfaces and said second lens surfaces and a width W of said slit satisfy a relation:

$$P/2<D<P/2+0.7\sqrt{(W)}$$

wherein at least one of said first face and said second face is processed for at least one of light absorption and light scattering except for said lens surfaces.

28. The array as claimed in claim 27, further comprising a rib formed at a corner where at least one of a face of said imaging device array where said first lens array is positioned and a face where said second lens array is positioned and a face where said roof prism array is positioned join each other, said rib extending in a direction of arrangement of said unit imaging devices for guaranteeing mechanical strength.

* * * * *